US006721531B2

(12) United States Patent
Kishimoto et al.

(10) Patent No.: US 6,721,531 B2
(45) Date of Patent: Apr. 13, 2004

(54) FLASH FIXING APPARATUS AND PRINTER USING THE SAME

(75) Inventors: Teruki Kishimoto, Kawasaki (JP); Akira Iwaishi, Kawasaki (JP); Tomakazu Akuta, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/119,142

(22) Filed: Apr. 10, 2002

(65) Prior Publication Data

US 2003/0123913 A1 Jul. 3, 2003

(30) Foreign Application Priority Data

Dec. 27, 2001 (JP) ..... 2001-397713

(51) Int. Cl.[7] ..... G03G 15/20
(52) U.S. Cl. ..... 399/336
(58) Field of Search ..... 399/67, 320, 335, 399/336, 337

(56) References Cited

U.S. PATENT DOCUMENTS 4,386,840 A * 6/1983 Garthwaite et al. ..... 399/337
4,768,057 A * 8/1988 Kumada et al. ..... 399/336
5,296,906 A * 3/1994 Hano et al.
5,448,344 A * 9/1995 Itakura et al. ..... 399/336
5,521,689 A * 5/1996 Miyakoshi ..... 399/336

FOREIGN PATENT DOCUMENTS

JP 2870705 1/1999
JP 2000-089606 * 3/2000
JP 3217216 8/2001

* cited by examiner

*Primary Examiner*—Sandra Brase
(74) *Attorney, Agent, or Firm*—Westerman, Hattori, Daniels & Adrian, LLP

(57) ABSTRACT

Flash fixing equipment for fixing a toner image onto a medium by means of flashlight is to reduce non-uniformity of halftone image print density. Flash fixing unit has flash energy distribution consisting of a center zone and front/end zones. The flash frequency of the flash lamp is controlled so that the toner fixing start energy being subtracted from the added value of flash energies of front and end zones becomes substantially equal to the flash energy value on the center zone. The energy distribution exceeding the fixing start energy which affects print density (size of toner-overflowed area) is controlled to have a flat characteristic to reduce non-uniformity of print density.

14 Claims, 24 Drawing Sheets

FIG. 19

| | $\beta$ | $v$ [mm/sec] | $f$ [Hz] | INPUT ENERGY RATIO |
|---|---|---|---|---|
| CONVENTIONAL | 0.12 | 247.5 | 5.85 | 1 |
| EMBODIMENT 1 | 0.12 | 247.5 | 6.6 | 1.13 |
| COMPARATIVE 1-1 | 0.12 | 247.5 | 6.2 | |
| COMPARATIVE 1-2 | 0.12 | 247.5 | 7.2 | |
| EMBODIMENT 2 | 0.12 | 247.5 | 4.7 | 0.84 |
| COMPARATIVE 2-1 | 0.12 | 247.5 | 4.4 | |
| COMPARATIVE 2-2 | 0.12 | 247.5 | 5.4 | |

FIG. 20

| | | | | | | | | | |
|---|---|---|---|---|---|---|---|---|---|
| UN-UNIFORMITY OF FUSION ENERGY | −15% | −9% | −7% | −5% | 0 | +5% | +7% | +9% | +15% |
| UN-UNIFORMITY OF PRINT DENSITY | −15% | −9% | −7% | −5% | 0 | +5% | +7% | +9% | +15% |
| OBSERVED EVALUATION | × | × | ○ | ○ | ○ | ○ | ○ | × | × |

FLASH FIXING APPARATUS AND PRINTER USING THE SAME

BACKGROUND OF THE INVENTION

1. Field of the Invention

The present invention relates to flash fixing apparatus for fixing toners on a medium by a flashlight and a printer using the same, and more particularly flash fixing apparatus for fixing a high resolution toner image with reduced non-uniformity of halftone image density and a printer using the same.

2. Description of Related Arts

In a printer for forming a toner image using the electrophotographic method or the like, an image formed of powder toner is produced on a print medium. The image is then fixed by fusing the powder toner. Energy must be applied to the print medium to fix the toner image.

In a high-speed printer, a non-contact type fixing method is employed for applying the fixing energy. The non-contact type fixing method is suitable for fixing a toner image in a high-speed printer because the method enables to apply high fixing energy without affecting a print medium to carry.

As this non-contact type fixing method, there has been employed a flash fixing method using flashlight emitted from a flash lamp. In this flash fixing method, fixing is performed on each predetermined area on the print medium by flashing the flash lamp at predetermined intervals synchronously with carrying the print medium.

In such a flash fixing method, it is efficient to fix toner images on the predetermined area of the print medium by one-time flash. However, because the flash energy distribution of single flashlight is not uniform, it is performed to generally superpose a plurality of flashes in order to obtain uniform flash energy distribution. The fixing characteristic depends on both the light energy distribution and the range of superposition area. There have been proposed various arts to obtain a desired characteristic.

A first prior art is shown in FIG. 26, in which a trapezoidal reflection plate 112 is provided around a flash lamp 111 to produce light energy distribution 'e' onto a print medium 106. The produced energy distribution 'e' is configured so that 70%–80% of the total irradiation energy is concentrated onto a center zone 'a' of the irradiation area A. Providing that the length of the area into which 70% of the total irradiation energy is concentrated is defined as a fixing width W, the relation between moving velocity V of a continuous medium and flash frequency f of the flash lamp 111 is defined by formula (1) shown below.

$$V/f=W/n \quad (1)$$

In this formula, it has been proposed to set 'n' within a range of 1.2–1.8, preferably 1.3–1.7 (for example, as disclosed in the official gazette of Japanese Patent No. 2870705.)

Here, V/f denotes a moving distance of the continuous medium in a time between two flashes (in other words, an area length allotted for one flash.) This distance becomes shorter than the fixing width W by setting 'n' to the above-mentioned value. Accordingly, the fixing width is set so that superposition is always existent. This produces the light energy distribution E shown in FIG. 27 against the continuous medium. Thus prevention of non-uniform fixing is intended.

Now, according to a second prior art, such a reflection plate 112 as shown in FIG. 29(B) is provided around the flash lamp 111, so as to obtain a flat flash energy distribution characteristic at the center of the lamp, as shown in FIG. 29(A). Referring to FIGS. 28(A), 28(B), provided that a fixable area L2 is the width of the flash lamp 111, a half width L1 of the aperture of the reflection plate 112 is defined by the following formula (2), using the relation between moving velocity V of the continuous medium and flash period T of the flash lamp 111.

$$V/T \leq L1 \leq V/T-L2/2 \quad (2)$$

Namely, it has been proposed that the superposition width produced by the superposed flashes is set between the range of L1 (in maximum) and L1–L2/2 (in minimum) (for example, as disclosed in the official gazette of Japanese Unexamined Patent Publication No. Hei-6-308852.)

Such prior arts disclose method for suppress the variation in the flash energy distribution so as to prevent variation of the toner-fixing rate. In other words, the prior arts are based on the concept that the flash energy is more than sufficient for toner-fixing onto the entire area of a continuous medium, and that excess energy is prevented so that toner burst is not produced.

However, in recent years, it has been required to print halftone images, in addition to characters, and to print halftone images with high resolution. Grayscale is represented by the number of black dots in a predetermined area such as an example shown in FIG. 30, in which dot printing having alternating one 'on' dot and one 'off' dot repetitively in the sub scanning direction. In this example, as shown in FIG. 31, each dot size is larger in case of lower resolution (for example, 240 dpi), or smaller in case of higher resolution (for example, 600 dpi). Further, when the flash energy is applied, the toners within a dot are fused and the fused toners overflow outside the contour of the dot of interest. The size of the toner-overflowed area depends on the flash energy. That is, the overflowed area is relatively small when the flash energy is small, while the overflowed area is relatively large when the flash energy is large.

The difference of such overflowed areas is not so prominent in case of a relatively low resolution of a large dot in order of 240 dpi. However, in case of high resolution in order of 600 dpi, because a dot size is less than half in dot size compared to 240 dpi, the difference of dot diameter resulting from the difference in the overflowed area in the fixed image becomes prominent. In particular, in case of a halftone image, original halftone images having the identical grayscale look as if these images have different halftones.

In the conventional arts, it is intended to apply flash energy sufficient for fixing toner, and to suppress toner burst in case energy more than required for fixing is applied. There has not been considered non-uniformity of image density possibly produced by the fixing using flash energy.

For example, according to the conventional method for producing a uniform flash energy distribution using superposed flashes, there is obtained the density (by outputs of a densitometer) shown in FIG. 32 after fixing the print pattern shown in FIG. 30. As can be seen, the density value varies more than 10, producing a prominent density fluctuation. Especially the output decreases at both the center zone of the fixing and the superposition zone, thus producing stripes (banding).

This is caused by the determination of flash energy distribution, fixing width and superposing width from the viewpoint of preventing non-uniform fixing. There has not been considered variation of flash energy more than the fixing energy. Accordingly, as far as employing conventional superposition theory, it is difficult to prevent non-uniformity of print density under high-resolution printing.

SUMMARY OF THE INVENTION

Accordingly, it is an object of the present invention to provide a flash fixing apparatus and a printer using the flash fixing unit for preventing non-uniformity of print density, not only non-uniformity of fixing.

It is another object of the present invention to provide a flash fixing apparatus and a printer using the flash fixing unit capable of high resolution printing reducing non-uniformity of print density.

It is still another object of the present invention to provide a flash fixing apparatus and a printer using the flash fixing unit capable of high resolution printing reducing non-uniformity of print density of a halftone image.

It is still another object of the present invention to provide a flash fixing apparatus and a printer using the flash fixing unit capable of reducing both power consumption and non-uniformity of print density.

To attain the aforementioned objects, a flash fixing apparatus according to the present invention includes a flash fixing unit having a flash lamp and a reflection plate disposed to surround the flash lamp excluding at an aperture portion and for reflecting light from the flash lamp to direct toward the aperture portion, and a controller for controlling to flash the flash lamp. Here, the aforementioned flash fixing unit has an energy distribution characteristic produced by one-time flash against the medium, having substantially constant values at a center zone and decreasing values at both a front zone and a rear zone as each position therein becomes farther from the center zone. The controller controls to flash the flash lamp with such a flash frequency that an energy value obtained by subtracting a toner-fixing start energy value from an added value at both the front zone and the rear zone falls within a predetermined range of the value at the center zone.

Further, according to the present invention, a printer includes the aforementioned flash fixing apparatus and an image forming unit for forming a toner image onto a medium.

The present invention is based on a technical idea to make energy distribution (fusion energy distribution) exceeding the fixing start energy flat, instead of providing flatness in flash energy distribution over one-time flash zone and superposition zone. Here, the aforementioned fusion energy distribution affects print density (which depends on the size of toner-overflowed area). Accordingly, it becomes possible to obtain a high-resolution print image with reduced non-uniformity of print density.

According to the present invention, preferably the controller controls to flash the flash lamp with a flash frequency f which satisfies the following formula:

$$g(x)+g'(v/f+x)-\beta H\pm\alpha\ \%$$

where, v is feeding velocity, f is flash frequency, H is energy value at the center zone, g(x) is a characteristic at the front zone, g'(v/f+x) is a characteristic at the rear zone, and β is the fixing start energy.

This enables to produce a high-resolution halftone print image having the density of reduced non-uniformity which an observer hardly identifies.

Further, preferably '7' is used as the aforementioned value α, aiming to extend tolerable range of the flash frequency.

Still further, according to the present invention, preferably the minimum value of flash energy within a flash energy distribution range corresponding to a reflection plate aperture width corresponds to the fixing start energy. This enables to reduce input energy (power consumption).

Further, according to the present invention, preferably the reflection plate shape is structured such that the minimum value of flash energy within the flash energy distribution range corresponding to the reflection plate aperture width corresponds to the fixing start energy. This reflection plate shape enables to reduce input energy.

According to the present invention, preferably the reflection plate is constituted of side reflection portions, a ceiling reflection portion, and a convex portion disposed in the ceiling reflection portion. With this reflection plate shape, input energy can be reduced.

Further scopes and features of the present invention will become more apparent by the following description of the embodiments with the accompanied drawings.

BRIEF DESCRIPTION OF THE DRAWINGS

FIG. 19 shows an explanation diagram of setting values for flash fixing units according to the first and the second embodiments of the present invention.

FIG. 20 shows a diagram illustrating the relation between non-uniformity of the print density and subjective evaluation according to the present invention.

DETAILED DESCRIPTION OF THE PREFERRED EMBODIMENTS

The preferred embodiment of the present invention is described hereinafter referring to the charts and drawings in order of a printer, flash fixing apparatus, an embodiment thereof and other embodiments.

[Printer]

Figure 1:
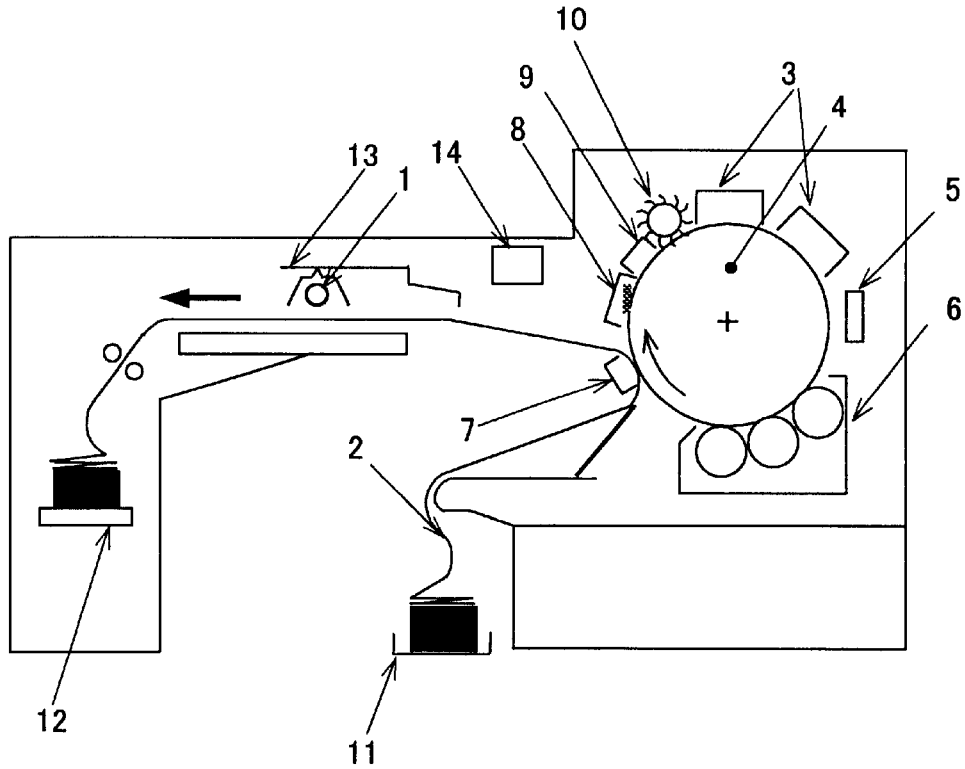
FIG. 1 shows a configuration diagram of a printer according to an embodiment of the present invention.
Figure 2:
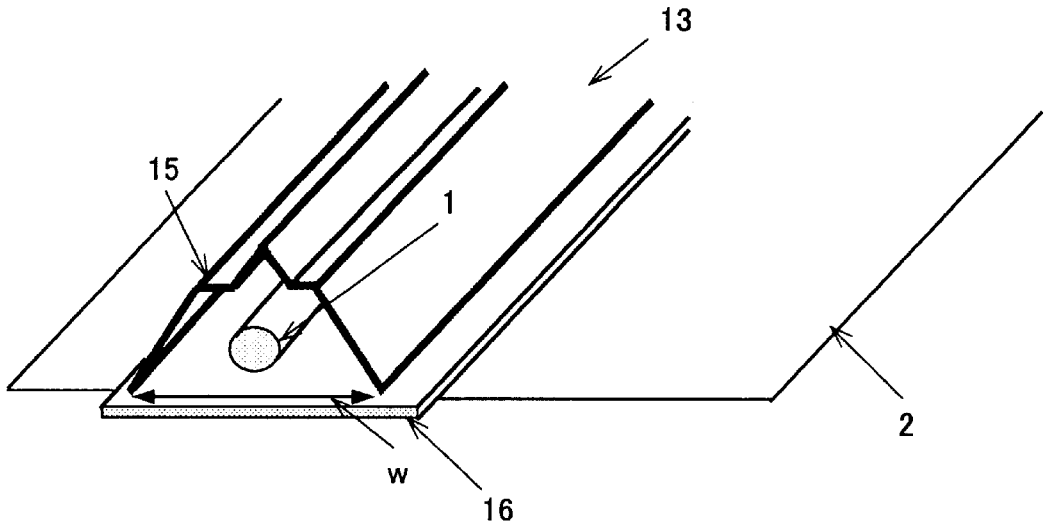
FIG. 2 shows a configuration diagram of a flash fixing unit shown in FIG. 1.
Figure 3:
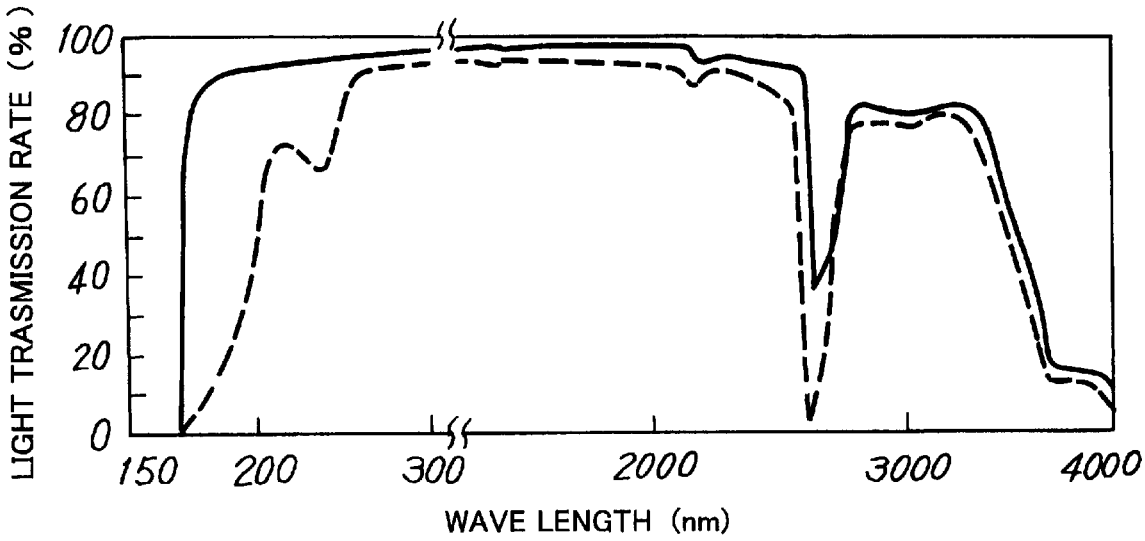
FIG. 3 shows an optical characteristic diagram of a glass plate shown in FIG. 2.

FIG. 1 shows a configuration diagram of a printer according to an embodiment of the present invention. FIG. 2 shows a configuration diagram of the flash fixing equipment shown in FIG. 1. Also, FIG. 3 shows a characteristic diagram of a glass plate provided in the flash fixing unit shown in FIG. 2.

FIG. 1 shows a configuration of an electrophotographic printer handling continuous paper according to one embodiment of the present invention. Continuous paper 2 loaded on a paper hopper 11 is conveyed continuously by a feeding system and is accommodated into a stacker 12 through a transfer unit 7 and a fixing unit 13.

A photosensitive drum 4 rotating clockwise is uniformly charged by a charge unit 3, and then is exposed an image by an optical system 5. An electrostatic latent image corresponding to the image is formed on the photosensitive drum 4. The electrostatic latent image produced on the photosensitive drum 4 is developed by a developing unit 6. And then the toner image on the photosensitive drum 4 is transferred onto the continuous paper 2 by the transfer unit 7.

After the transfer, a charge eliminator 9 eliminates charge loaded on the photosensitive drum 4. Also residual toner is cleaned up by a cleaning blade 8 and a cleaning brush 10. The continuous paper on which the toner image is transferred is flash-fixed by flash fixing unit 13, and thereafter the paper is housed into stacker 12. A flash control unit 14 controls flashing (flash frequency) of a flash lamp 1 provided in the flash fixing unit 13.

FIG. 2 shows a perspective view of flash fixing unit 13. As shown in FIG. 2, the flash fixing unit 13 includes the flash lamp 1, a reflection plate 15, and a light transmission plate 16. As the flash lamp 1, there is employed an ozoneless silica glass tube of a cylinder form having an arc length of 502 [mm] in which Xe gas of 220 [Torr] is sealed.

Further, the light transmission plate 16 structured by a glass plate is provided between the flash lamp 1 and the continuous paper 2. Preferably this glass plate is formed of a water-containing synthetic silica glass produced by the VAD (vapor phase axial deposition) method. FIG. 3 shows glass transmittance versus light emission wavelengths. In this figure, a broken line indicates the transmittance of the conventional flame-fused silica glass, while the solid line indicates the transmittance of the aforementioned synthetic silica glass produced by the VAD method. In case of the synthetic silica glass by the VAD method has an increased transmittance in the infrared light region (the wavelength of which is near 2000 nm), which contributes to improve fixing quality using a toner having an absorption wavelength in this region.

The reflection plate 15 is provided so as to cover the flash lamp 1. Desirably the portions inside the case are aluminum-deposited with reflection enhancement processing thereafter. According to the present invention, this reflection plate 15 produces flash energy distribution having a substantially trapezoidal form.

[Flash Fixing Unit]

Figure 4:
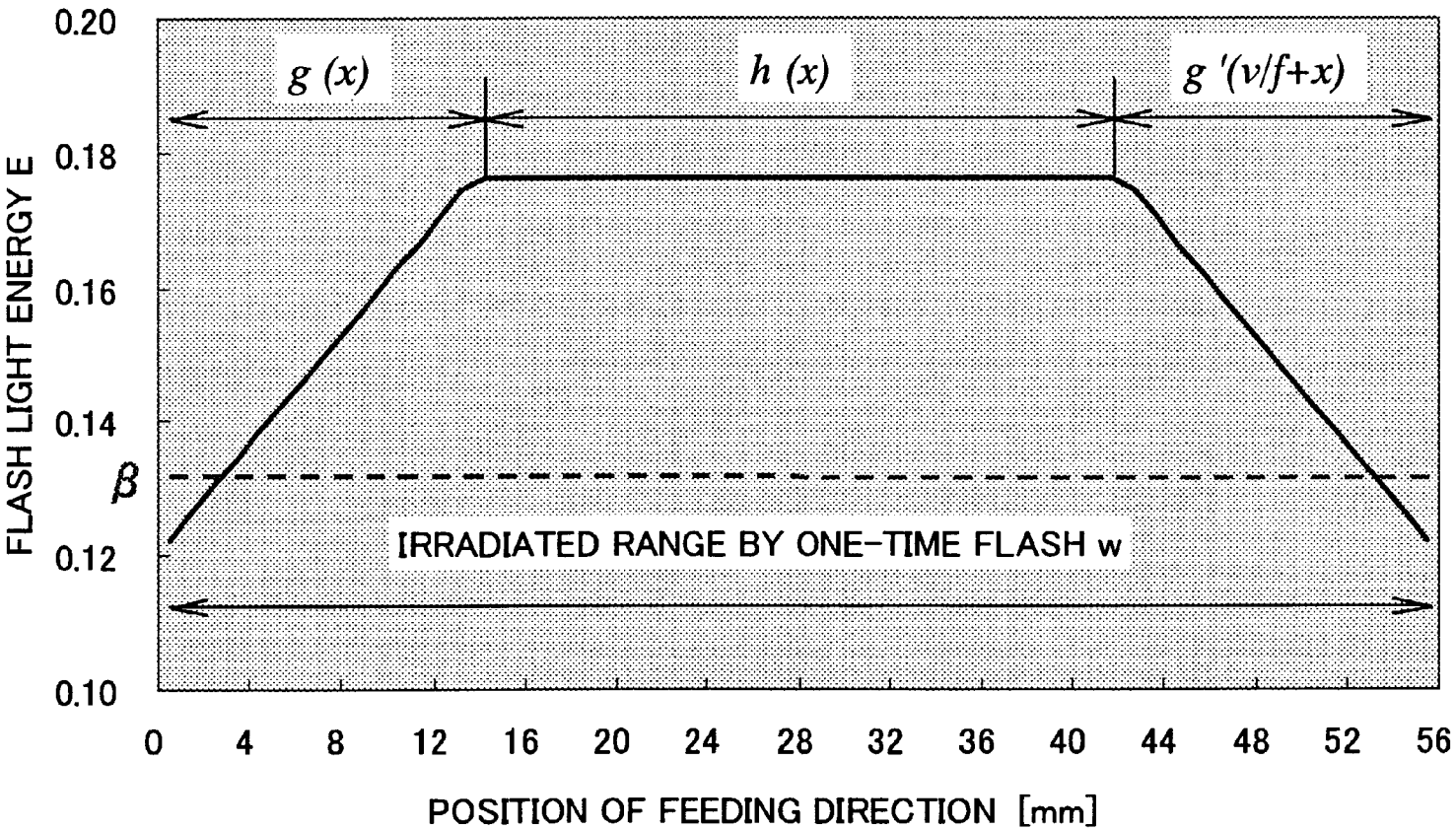
FIG. 4 shows a model diagram of flash energy distribution
Figure 5A:
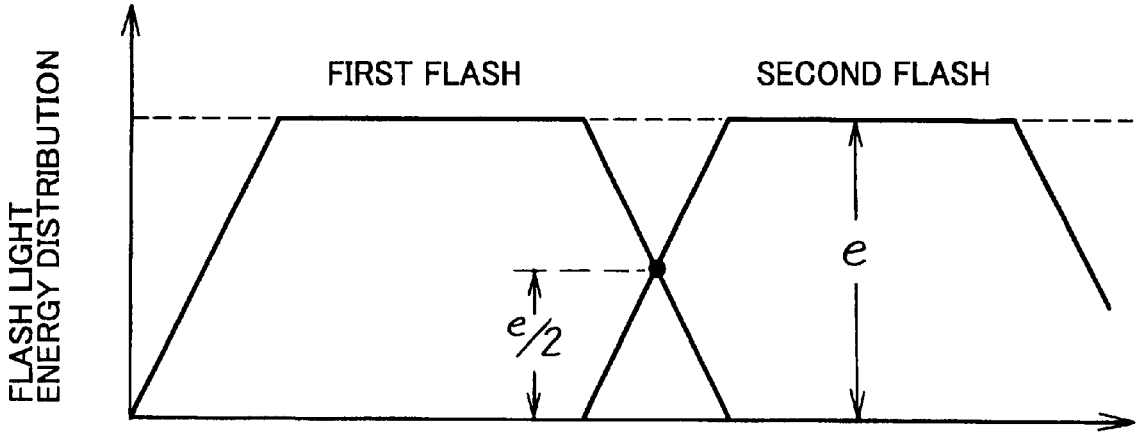
FIGS. 5(A), 5(B) and 5(C) show flashlight superposition method according to the present invention.
Figure 5B:
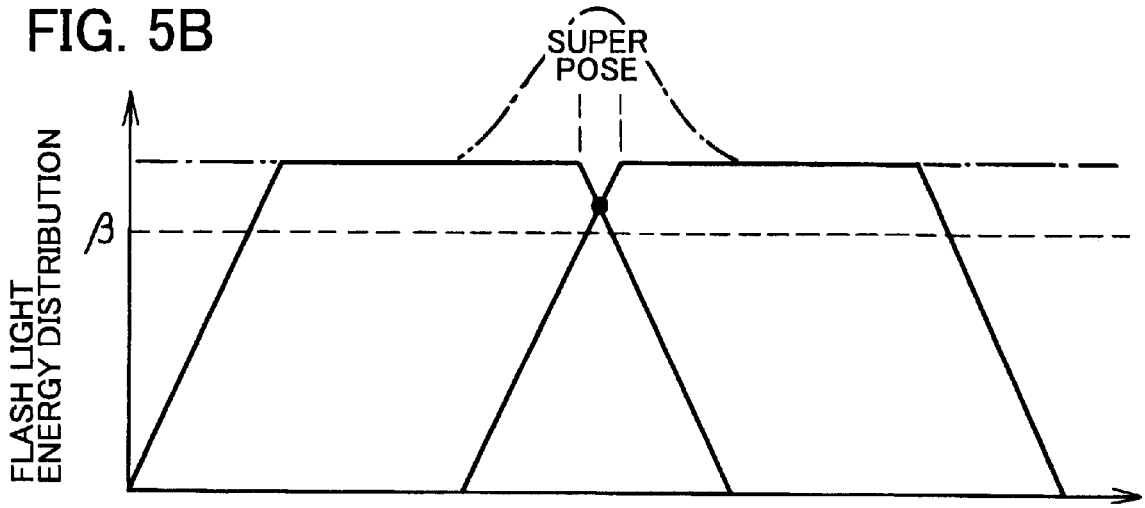
Figure 5C:
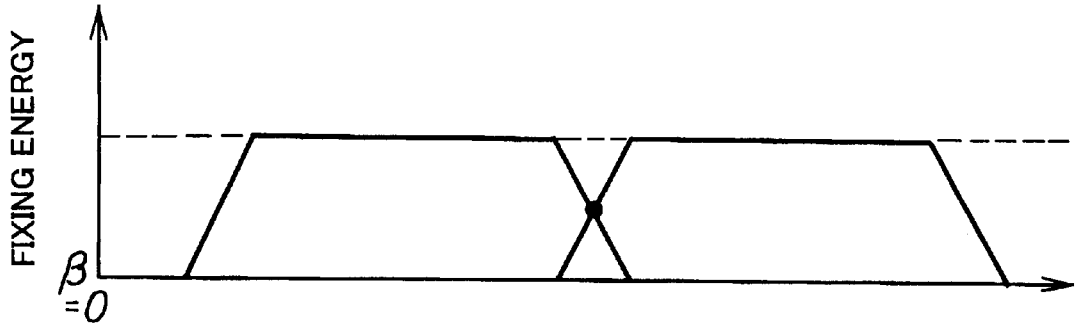

FIG. 4 shows a model diagram of flash energy distribution produced by one-time flash of flash fixing unit 1 according to the present invention. Also, FIGS. 5(A) to 5(C) show explanation diagrams of the superposition method using continuous flashes of the flash fixing unit according to the present invention.

According to the present invention, as shown in FIG. 4, the flash energy distribution model has a characteristic denoted by h (x) that is substantially constant in the center zone along the feeding direction, and g(X) and g'(v/f+x), respectively, decrease as the distance from the center zone increases. Here, 'v' denotes feeding velocity of the continuous paper, and 'f' denotes the flash frequency of the flash lamp.

According to the present invention, the reflection plate 15 is employed so as to obtain the aforementioned flash energy distribution by one-time flash, as mentioned later. Namely, the flash energy distribution is modeled to have a flat characteristic at the center zone as well as predetermined descending characteristics at both side zones.

Figure 6:
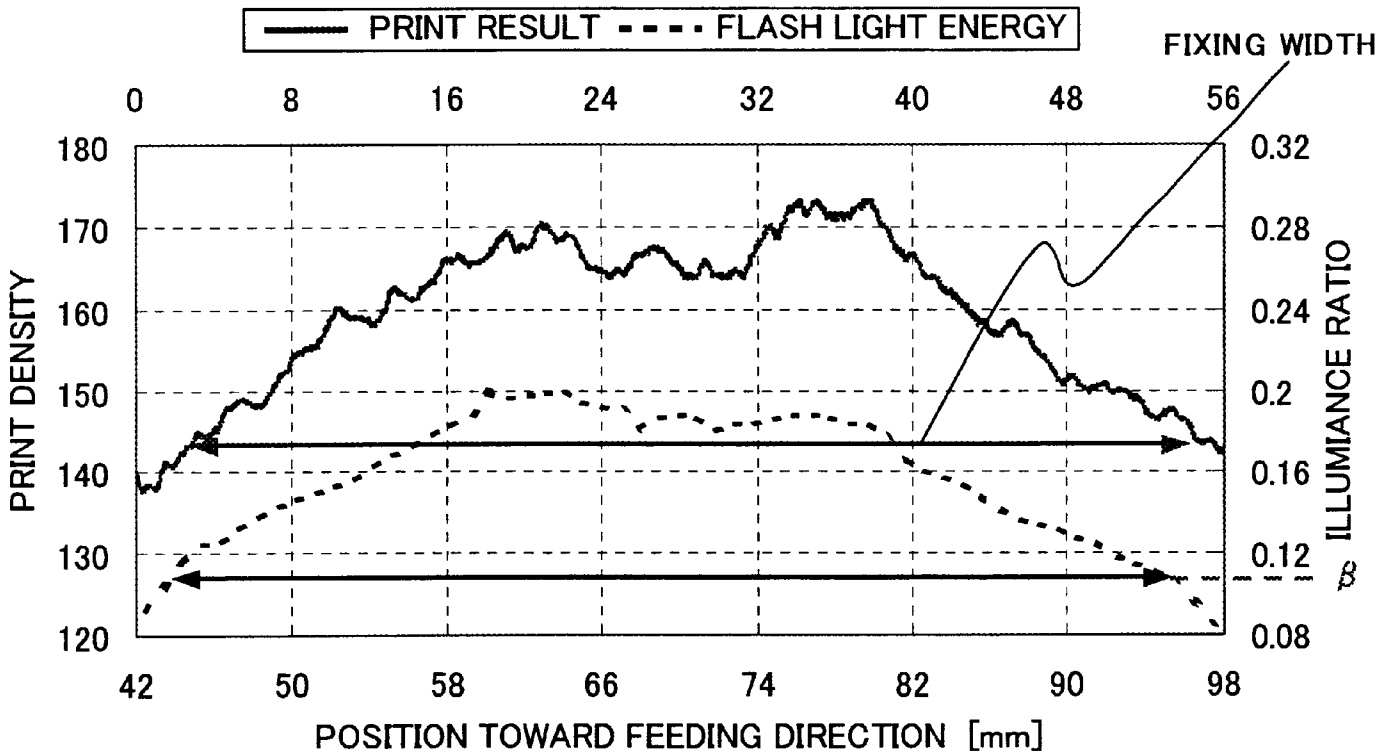
FIG. 6 shows a diagram illustrating the relation between flash energy distribution and print density.

Next, it is assumed that the energy level at which physical property of toner starts to change non-reversively is denoted as β, which is defined as the minimum energy required for toner-fixing onto paper (hereinafter referred to as 'fixing start energy'). This β is derived from a correlation between flash energy and density after flash-fixing. More specifically, in FIG. 6 showing a relation diagram between flash energy distribution (dotted line) and print density (solid line), for example, the flash fixing unit flashes a uniform halftone toner image similar to the image shown in FIG. 30 under no flashlight superposition condition. Thereafter a tape is pasted with a certain pressure onto the toner image and then the tape is torn off. The fixing width is obtained by measuring a toner width adhered to the tape. The flash energy corresponding to this toner width is determined as β.

Now, regarding the superposition of flashlight, the energy in the superposition zone caused by superposed flashes is calculated, taking the aforementioned fixing start energy β into consideration. Once flash energy exceeding the fixing start energy β is applied by a first flash, print density is affected by an amount of the flash energy in a second flash which exceeds the fixing start energy β. Therefore, according to the present invention, the energy on the superposition zone is calculated by the following formula (3).

$$\text{Energy applied to the superposition zone}=\text{Energy applied before the superposition}+(\text{Superposed energy}-\beta) \quad (3)$$

Here, on condition that the value in the parentheses comes to below zero, zero is substituted for the value in the parentheses.

Also, length L of the superposition zone can be obtained by the following formula (4).

$$L=W-v/f \quad (4)$$

If the energy in the superposition zone becomes equal to the energy h(x) in the center zone, the fusion energy distribution having entirely flat characteristic can be obtained. Namely, when the following formula (5) becomes true, an ideal fusion energy distribution of entirely flat characteristic can be obtained in continuous running condition.

$$g(x)+g'(v/f+x)-\beta=h(x) \quad (5)$$

Here, according to the conventional arts, in order to obtain flat energy distribution, it is intended to superpose in such a way that the energy amount by a first flashlight F1 and a second flashlight F2 intersects at a half of the maximum flash energy 'e', (i.e.e/2) as shown in FIG. 5(A). However, according to this superposition, it is not possible to prevent non-uniformity of print density, though the flash energy distribution becomes flat. In other words, the density produced in the superposition zone becomes thinner than the density produced in the center zone.

Figure 31:
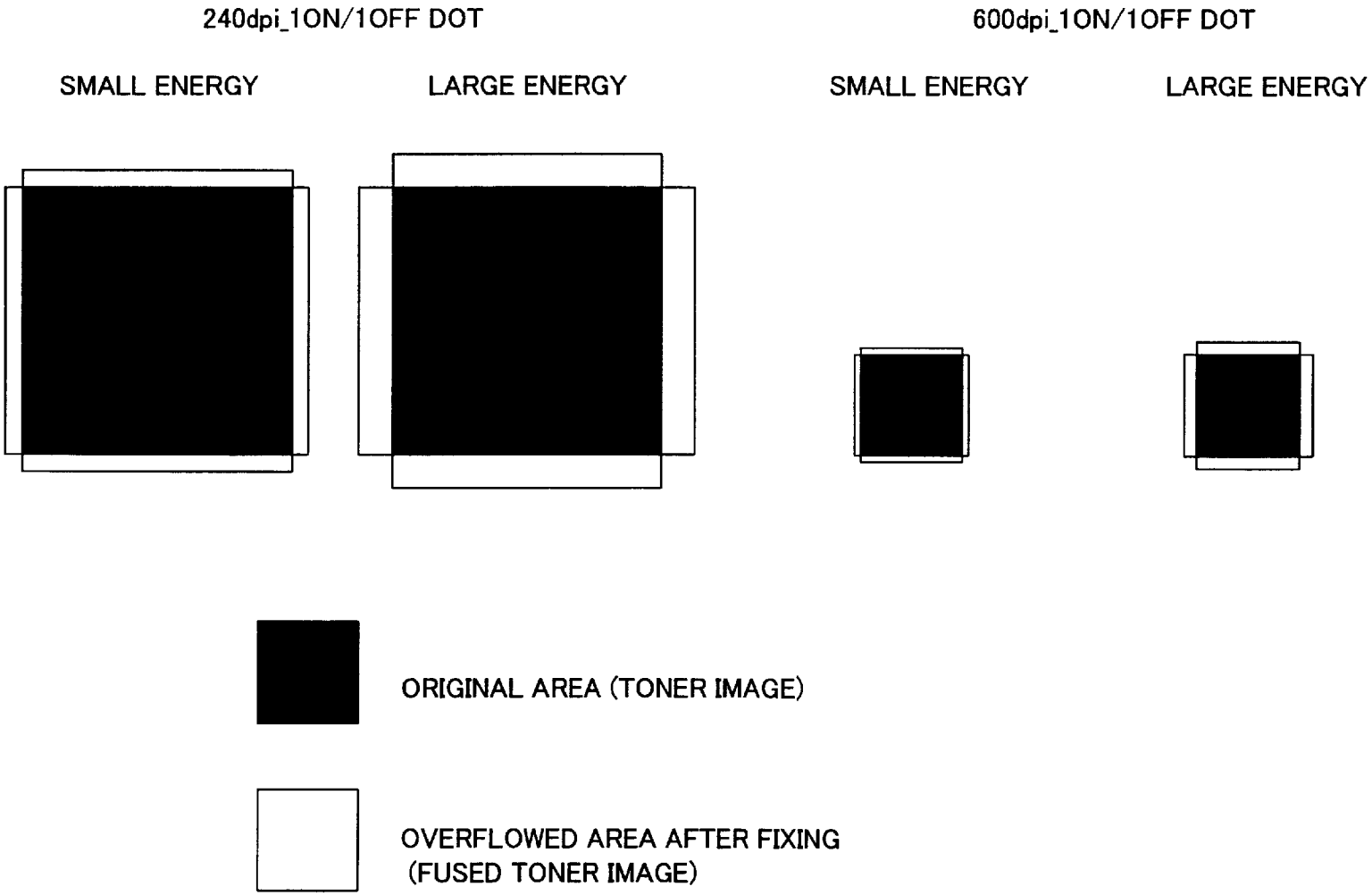
FIG. 31 shows an explanation diagram illustrating a cause of non-uniform print density produced by the prior arts.
Figure 32:
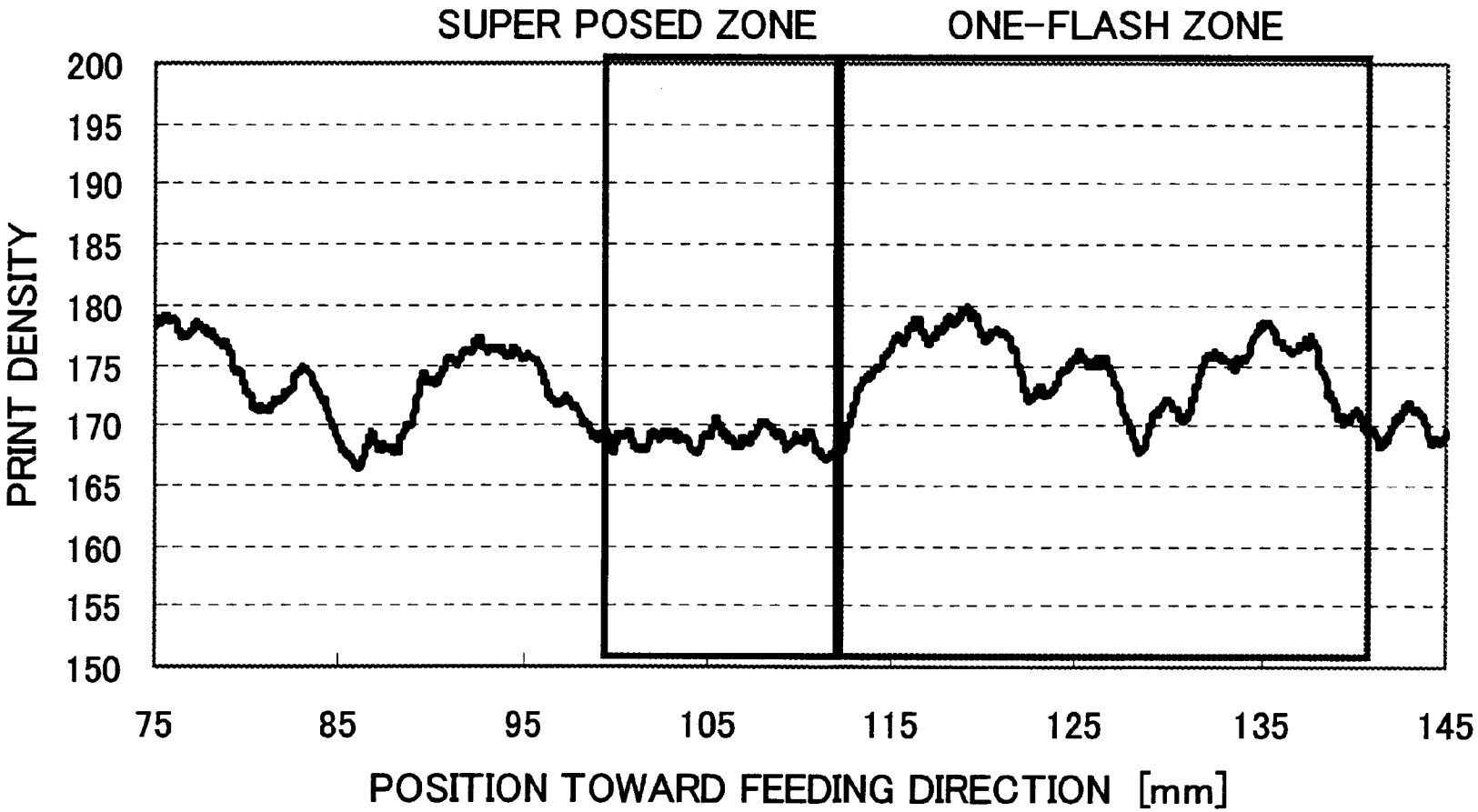
FIG. 32 PRIOR ART
FIG. 32 shows an explanation diagram of non-uniform print density produced by the prior arts.

The present invention is based on the following principle: As having been explained in FIG. 4, toner can be fixed only when the applied energy exceeds the fixing start energy. Once the fixing start energy is applied, a flash energy amount more than the fixing start energy determines an overflowed area size shown in FIG. 31.

And according to the present invention, an idea is taken to produce energy distribution (fusion energy) exceeding the fixing start energy to have a flat characteristic, which affects the print density (caused by the size of toner-overflowed area), instead of the prior art of providing flat flash energy distribution over one-time flash zone and superposition zone.

For this purpose, the fixing start energy β is added to the superposition condition. Namely, as shown in FIG. 5(B), the intersection energy in which the first flashlight F1 and the second flashlight F2 is intersected is set to exceed the fixing start energy β. Thus the fusion energy distribution having more than the fixing start energy becomes flat, as shown in FIG. 5(C). Aforementioned formula (3) means the above measure. Accordingly, as shown by the chained line in FIG. 5(B), the flash energy in the superposition zone is different from the flash energy in the center zone, that is, the flash energy distribution is not flat. Instead, the fusion energy distribution becomes flat as shown in FIG. 5(C), thus enabling to prevent non-uniformity of the print density.

However, there are often difficult cases to produce such an ideal fusion energy distribution. For example, there lies dispersion in accuracy of the reflection plate shape, accuracy of flash lamp disposition, flash energy, and the like. Therefore, according to the present invention, the condition in formula (5) is mitigated to the extent that observers of the produced image can hardly distinguish the non-uniformity of the print density, so as to facilitate actual implementation. As will be mentioned later, by incorporating observers' subjective evaluation, formula (5) can be mitigated to the following formula (6).

$$g(x)+g'(v/f+x)-\beta=H\ \pm 7\% \quad (6)$$

where H denotes a median of h(x).

Namely, according to the present invention, there is provided a flash fixing unit including a reflection plate having substantially constant flash energy distribution at the center zone. The superposition width is determined in such a way that the fusion energy at the superposition zone becomes substantially identical to the fusion energy at the center zone. The above superposition width is determined by flash frequency of the flash lamp and the carriage velocity. In the configuration shown in FIG. 1, feeding velocity v has been determined as a prerequisite. Therefore the flash frequency 'f' of the flash lamp 1 controlled by the flash control unit 14 is determined so as to satisfy formula (6).

Figure 7:
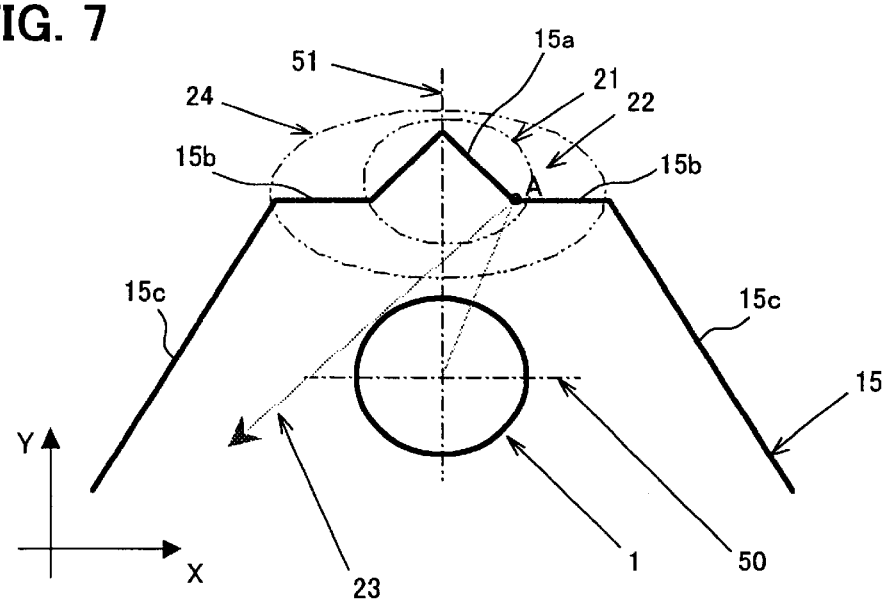
FIG. 7 shows a preferred configuration diagram of a reflection plate for enabling the flash energy distribution shown in FIG. 4.
Figure 8A:
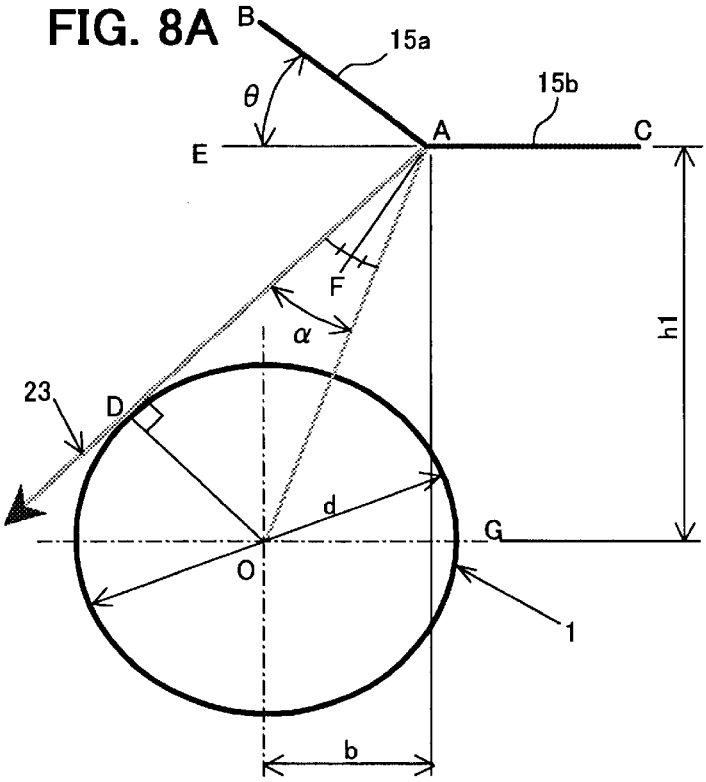
FIGS. 8(A) and 8(B) show explanation diagrams of a reflection angle of the reflection plate shown in FIG. 7.
Figure 8B:
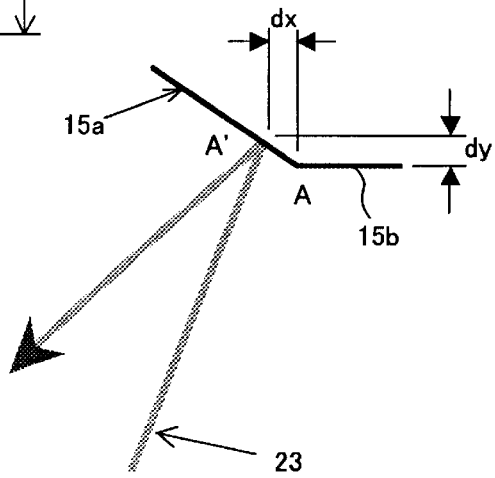
Figure 9:
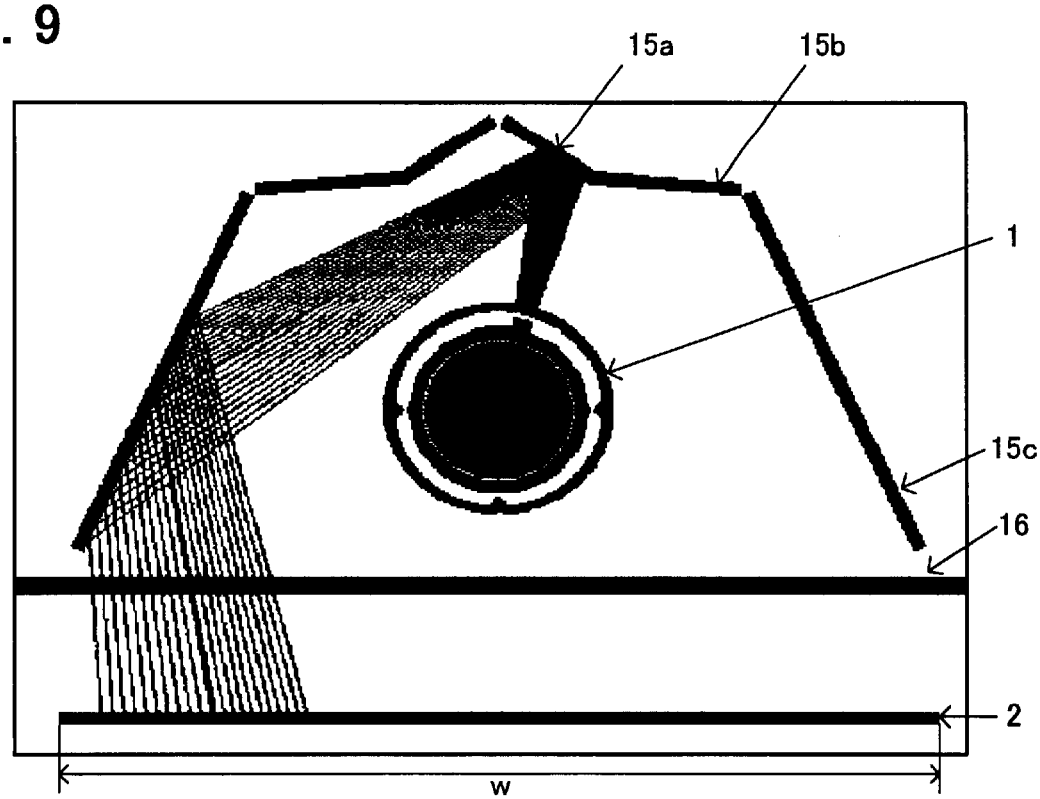
FIG. 9 shows an explanation diagram of light arrangement control against a convex portion of the reflection plate shown in FIG. 7.
Figure 10:
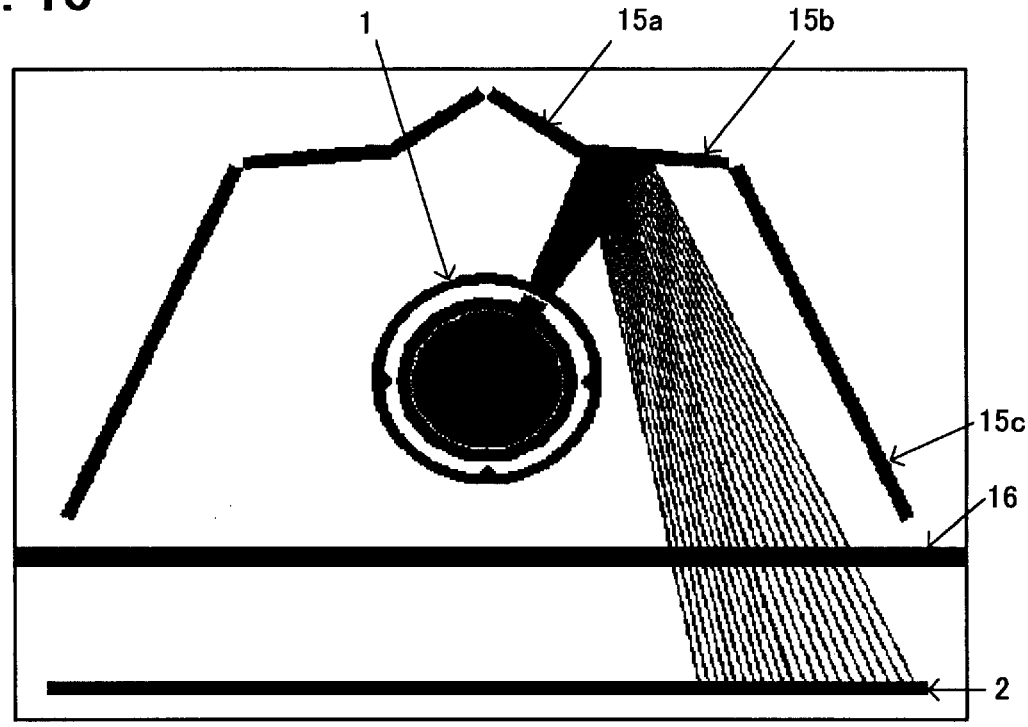
FIG. 10 shows an explanation diagram of light arrangement control against a ceiling of the reflection plate shown in FIG. 7.

Now, hereafter there is described a reflection plate preferable for obtaining the aforementioned flash energy distribution. FIG. 7 shows a cross-sectional view of an embodiment of flash lamp 1 and the reflection plate 15 in the flash fixing apparatus according to the present invention. FIGS. 8(A), 8(B) show partially enlarged diagrams of the flash lamp and the reflection plate shown in FIG. 7. FIGS. 9, 10 show explanation diagrams of light arrangement control by means of reflection plate 15.

As shown in FIG. 7, the reflection plate 15 disposed around the flash lamp 1 is constituted by both side reflection faces 15*c*, a ceiling face 15*b* and a top face 15*a*. The ceiling face 15*b* and the top face 15*a* constitute a ceiling 24 of reflection plate 15. On this ceiling 24, there is formed a convex portion 21 constituted by the top face 15*a*. In other words, the reflection plate 15 includes a trapezoid portion and a convex portion being formed on the ceiling of the trapezoid portion.

By means of such a reflection plate 15, light arrangement control for the reflection light of the flash lamp 1 is performed in the following way. First, an inclination of reflective top face 15*a* constituting the convex portion 21 is set in so that an incident light beam 23 from the flash lamp 1 is reflected at the upper side of the flash lamp 1 and is evaded to the left side of the flash lamp 1. However, this reflection beam 23 cannot enter directly into an irradiation area W formed by one flashing. Therefore, through the side reflection face 15*c*, the reflection beam 23 is collected to the irradiation area W. Here, the flash beam 23 is collected into a desired area by modifying an angle of the side reflection face 15*c*.

Next, as shown in FIG. 10, an inclination of the reflection ceiling face 15*b* out of the convex portion 21 is set so that the reflection beam of an incident beam 23 from the flash lamp 1 is evaded to the right side of the flash lamp 1 in the figure. Further, an inclination angle of the side reflection face 15*c* is set so that the flash beam 23 is collected into a desired area of the irradiation area W formed by one flashing.

In FIGS. 9, 10, the description is referred to the top face 15*a* and the ceiling face 15*b* located on the right side of the flash lamp 1. The top face 15*a* and the ceiling face 15*b* located on the left side of the flash lamp 1 have the same function.

In addition, according to the present invention, the form of the reflection plate 15 is configured so that any reflection beam may not return to the flash lamp 1. If the reflection light returns to the flash lamp 1, the reflection beam is disturbed, absorbed and strayed by the effects of the lamp itself and a trigger wire in the lamp. As a result, efficiency of the light from the flash lamp 1 to be used for the toner fixing is degraded. According to this embodiment of the present invention, the reflection light returning to flash lamp 1 is prevented and thus efficiency is improved.

As shown in FIG. 7, it is assumed that the center lines of the flash lamp 1 in the directions of X-axis and Y-axis are defined as 50, 51, respectively, with the center of flash lamp 1 being defined as an origin. Under this assumption, the convex portion 21 originated from point A is extended up to the intersection of the vertical center line 51. Various ways can be considered for this extension using a straight line, using a quadratic curve, or the like. In this embodiment, the following description is based on the simplest way of extending using a straight line.

As shown in FIG. 8(A), the beam emitted from the center O of flash lamp 1 (hereafter simply referred to as origin O) collides to a bent point 'A' of the reflection plate 15. For the sake of easy understanding, as shown in FIG. 8(B), it is assumed that the collision is made at point A' which deviates from bent point A by dx, dy. At point A' of the top face 15*a* of the convex portion 21, the beam 23 is reflected with an angle ∠FAD=α/2. At this time, an angle ∠BAE=θ for producing the form of the convex portion 21 is determined so that the locus rendered by the reflection beam 23 is a tangent at point D of the flash lamp 1 having a diameter d. In such away, it becomes possible to prevent the reflection beam from returning to the flash lamp 1.

Here, although point A and point A' are different, the locus produced by the beam 23 through point A and the locus through point A' are identical because dx, dy are negligibly small compared to the shape of the reflection plate. Assuming the coordinate of point A as (b, h1), ∠AOG and ∠OAD are as follows:

$$\angle AOG = \beta = \tan^{-1}\left(\frac{h1}{b}\right) \tag{7}$$

$$\angle OAD = \alpha = \sin^{-1}\left(\frac{d/2}{\sqrt{b^2 + h1^2}}\right) \tag{8}$$

Here, ∠AOG=∠OAE and ∠FAB=90°. Therefore, $$\angle BAE = \theta = 90 - (\angle OAE - \angle OAD/2) = 90 - \beta + \alpha/2 \tag{9}$$

Namely, by setting inclination θ of the top face 15*a* in the convex portion 21 so as to satisfy the following formula (10), it becomes possible to prevent the beam from returning to the flash lamp 1.

$$\theta \geqq 90 - \beta + \alpha/2 \tag{10}$$

Figure 11:
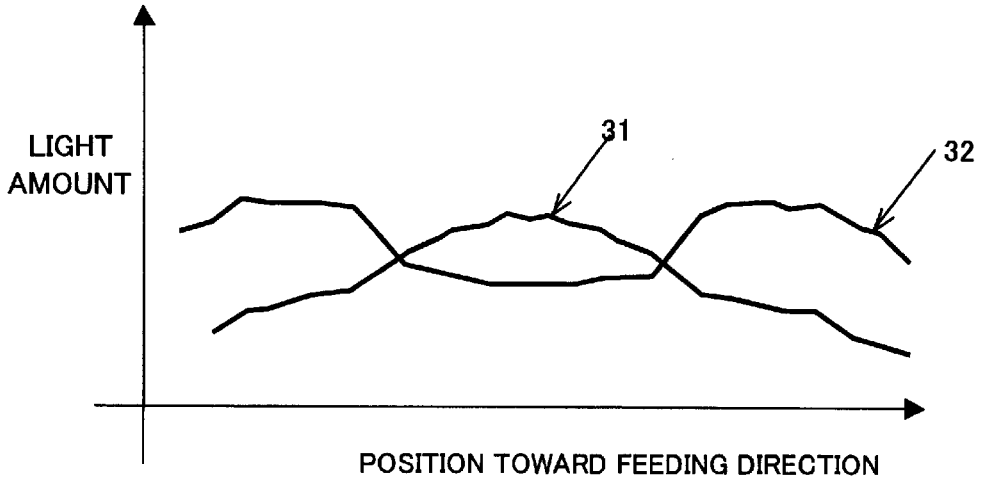
FIG. 11 shows an explanation diagram of light quantity distribution as a result of light arrangement control shown in FIGS. 9, 10.
Figure 12:
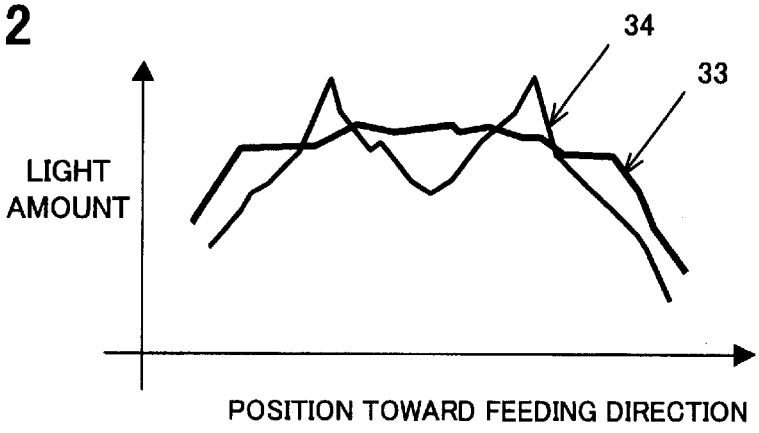
FIG. 12 shows an explanation diagram of flash energy distribution of a flash fixing unit shown in FIG. 7.
Figure 13:
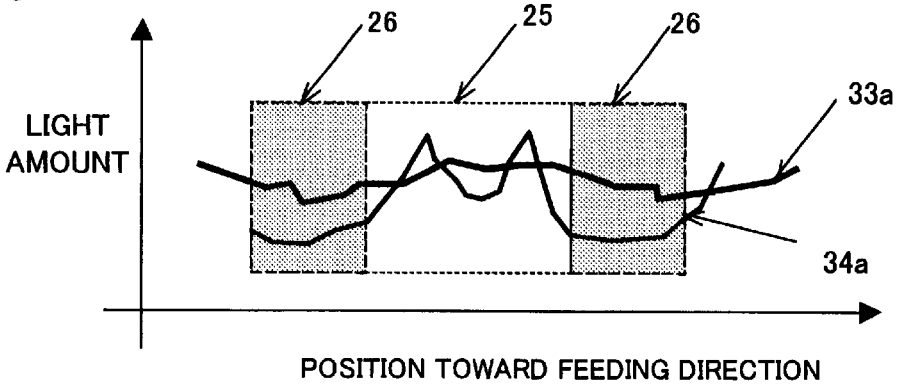
FIG. 13 shows a flashlight superposition method by means of the flash fixing unit shown in FIG. 7.

FIGS. 11, 12 show explanation diagrams of light arrangement control for flashlight shown in FIGS. 9, 10. FIG. 13 shows a flash energy distribution diagram at the superposition zone and the center zone being produced by the above-mentioned light arrangement control. As shown in FIG. 11, quantity of light by direct flashlight 31 directly incident onto the irradiation area W has a peak at the center of the flash lamp 1. Meanwhile, quantity of light by reflection light 32 being diffused by the reflection plate 15 has a bottom at the center.

As shown in FIG. 12, quantity of light (flash energy) of the irradiation light 34 resulting from the direct flashlight 31 plus the reflection light 32 becomes comparatively flat. In contrast, when the light arrangement control for the reflection light is not introduced, the flash energy distribution will become as shown in FIG. 34. Namely, as a whole, the flash energy distribution 33 in this embodiment has larger quantity of light, than the flash energy distribution 34 in case light arrangement control is not applied, and thus resulting in improved efficiency.

According to the embodiment of the present invention, as shown in FIG. 13, when superposition fixing is carried out using the aforementioned light 33*a*, non-uniformity in view of the quantity of light is corrected in both zones of the one-time flash zone 25 and the superposition zone 26, as compared to the light 34*a* without light arrangement control.

[Embodiments]

Hereafter the embodiments of the present invention are described more specifically, in which different reflection plates are employed. FIG. 14 shows a configuration diagram of a reflection plate according to a first embodiment of the present invention. FIG. 15 shows a diagram of flash energy distribution according to the configuration shown in FIG. 14.

Figure 14A:
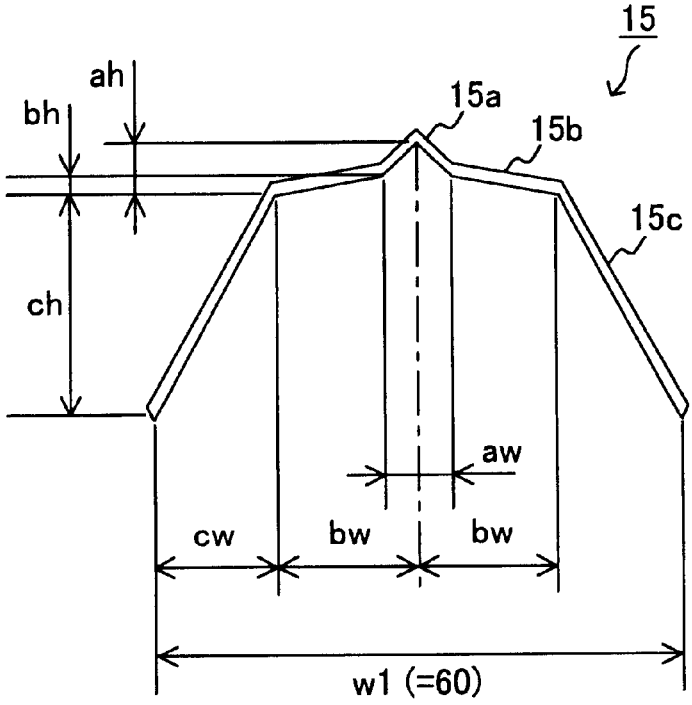
FIGS. 14(A) and 14(B) show configuration diagrams of the flash fixing unit according to a first embodiment of the present invention.
Figure 14B:
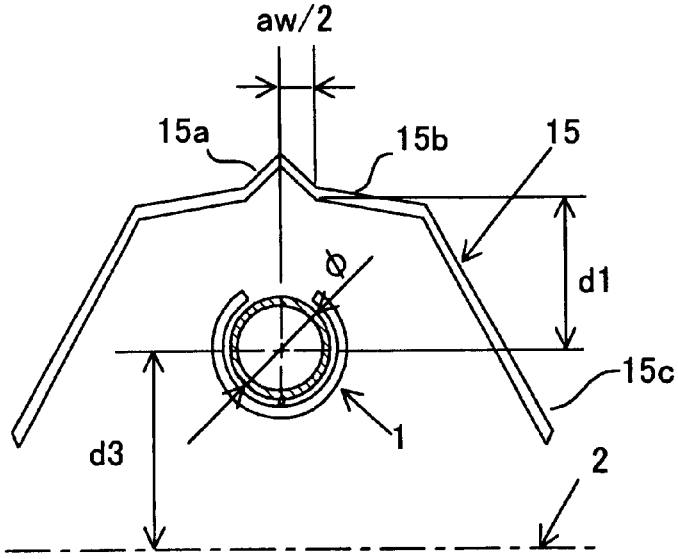
Figure 15:
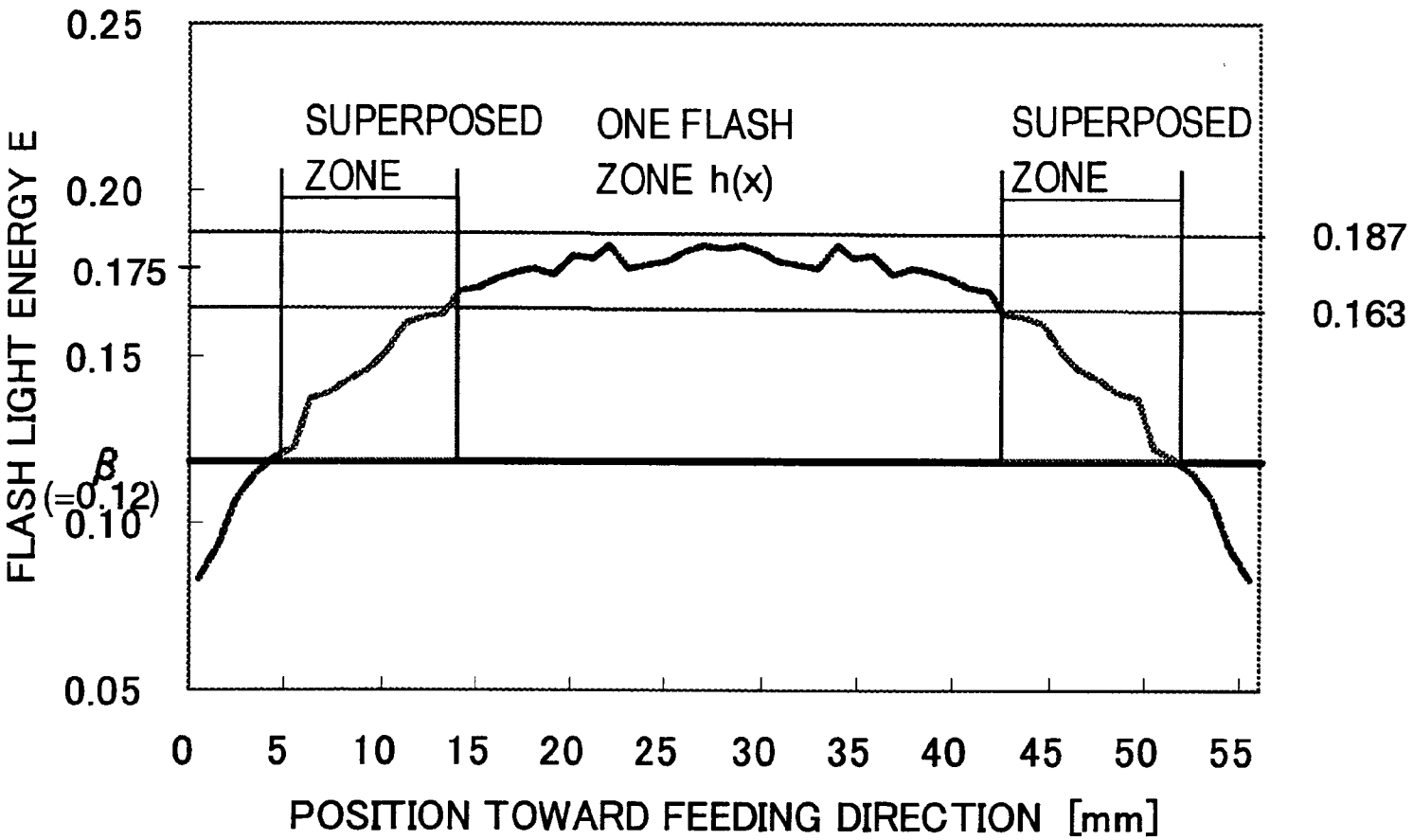
FIG. 15 shows a diagram of flash energy distribution in the flash fixing unit shown in FIG. 14(B).

Referring to FIG. 14(A), a reflection plate in the first embodiment of the present invention is constituted by the side reflection face 15*c*, the ceiling face 15*b*, and the top face 15*a*, thus being formed of trapezoidal shape having a convex portion as shown in FIG. 7. FIG. 14(B) shows a positional relation among the reflection plate 15, the flash lamp 1 and the continuous paper 2 in the flash fixing unit.

FIG. 15 is a calculation result of ray tracing by the Monte Carlo method using flash energy distribution of one-time flash in the flash fixing unit according to the first embodiment. In this figure, fixing start energy β (=0.12), the center zone (one-time flash zone) h(x) and the superposition zone are illustrated. Namely, h(x) of the center zone (one-time flash zone) is specified by a range of ±7% (here, 0.163–0.187) centering the median H (here, 0.175) in the aforementioned formula (6). Both side ends excluding the center zone define each superposition zone.

Figure 16A:
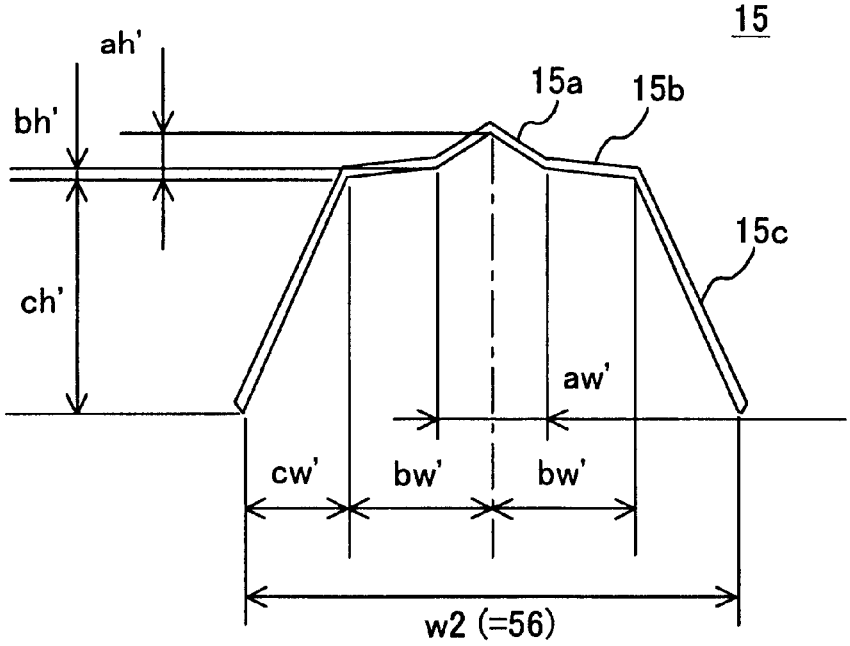
FIGS. 16(A) and 16(B) show configuration diagrams of the flash fixing unit according to a second embodiment of the present invention.
Figure 16B:
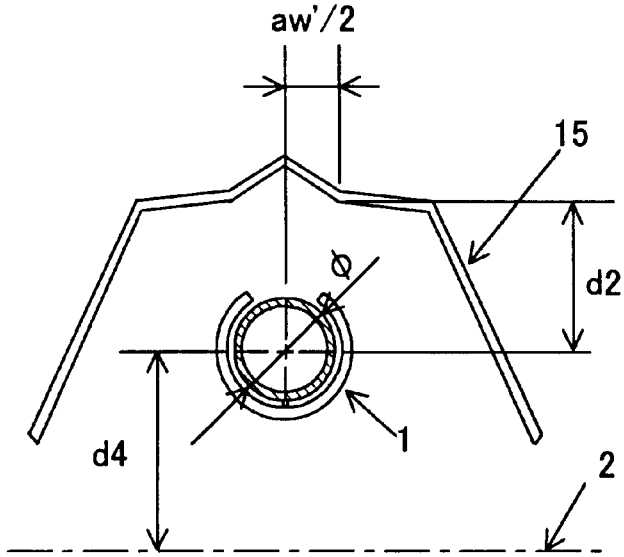

Next, a reflection plate according to the second embodiment is explained hereafter. FIG. 16(A) shows the reflection plate in the second embodiment, which is constituted by the side reflection face 15*c*, the ceiling face 15*b*, and the top face 15*a*, thus being formed of trapezoidal shape having a convex portion, as shown in FIG. 7. FIG. 16(B) shows a positional relation among the reflection plate 15, the flash lamp 1 and the continuous paper 2 in the flash fixing unit.

Figure 17:
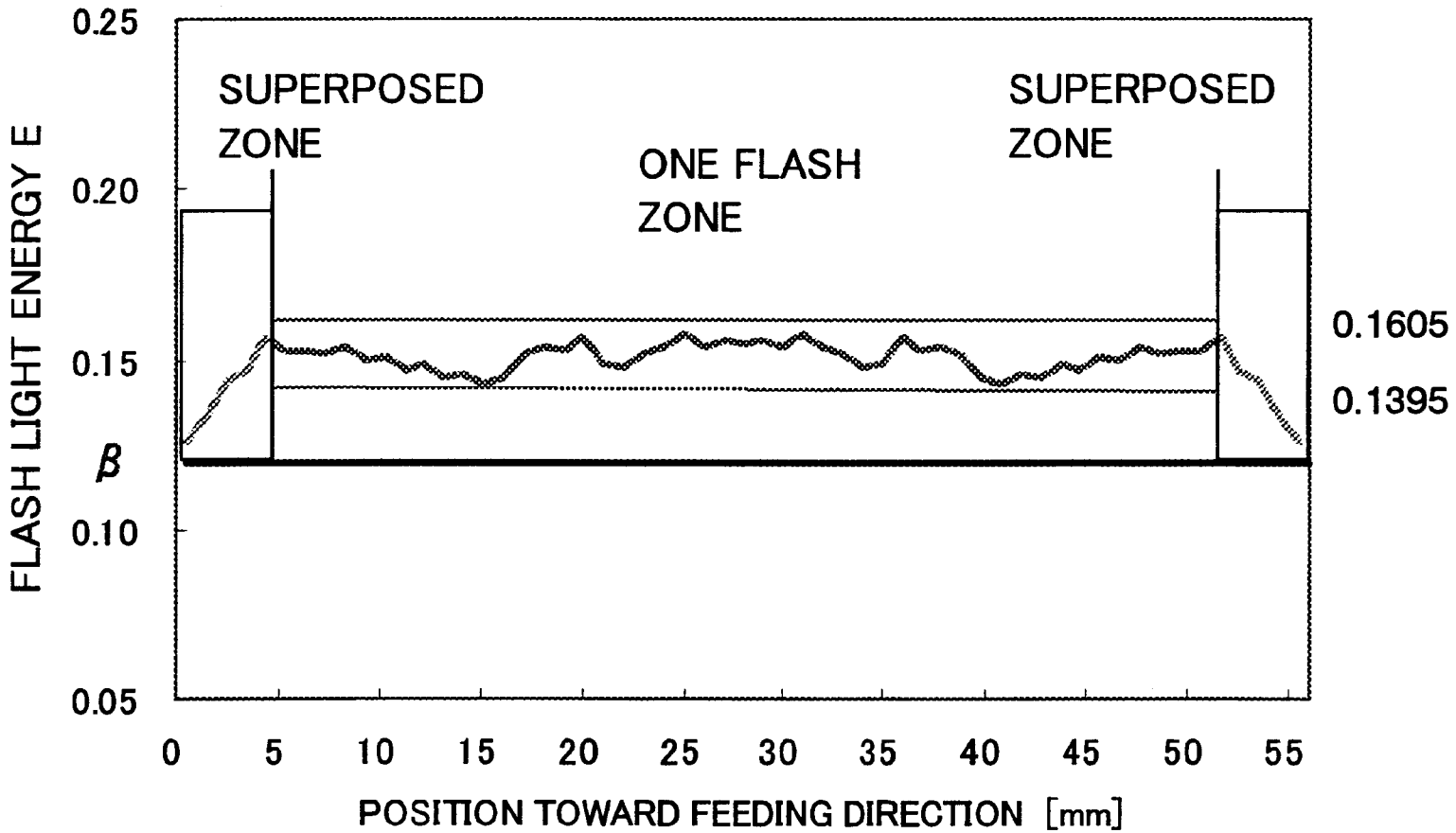
FIG. 17 shows a diagram of flash energy distribution in the flash fixing unit shown in FIG. 16.

FIG. 17 is a calculation result of ray tracing by the Monte Carlo method using flash energy distribution of one-time flash in the flash fixing unit according to the second embodiment. Compared to the reflection plate of the first embodiment, the reflection plate 15 of the second embodiment has a decreased inclination θ of the top face 15*a*, an increased width aw' (aw'>aw), and a increased inclination of the side reflection face 15*c* (cw'>cw).

Accordingly, as compared to the flash energy distribution of the first embodiment shown in FIG. 16, the flash energy on the center zone is dispersed to both end sides, resulting in approximately 1.6 times in width of the center zone (one-time flash zone) h(x). Namely, h(x) of the center zone (one-time flash zone) is specified by a range of ±7% (here, 0.1395–0.1605) centering the median H (here, 0.15) in the aforementioned formula (6). Both side ends excluding the center zone define each superposition zone. Thus, according to this second embodiment, within the area of the reflection plate 15 having aperture width W2 shown in FIG. 16, the flash energy exceeds the fixing start energy β.

Figure 18:
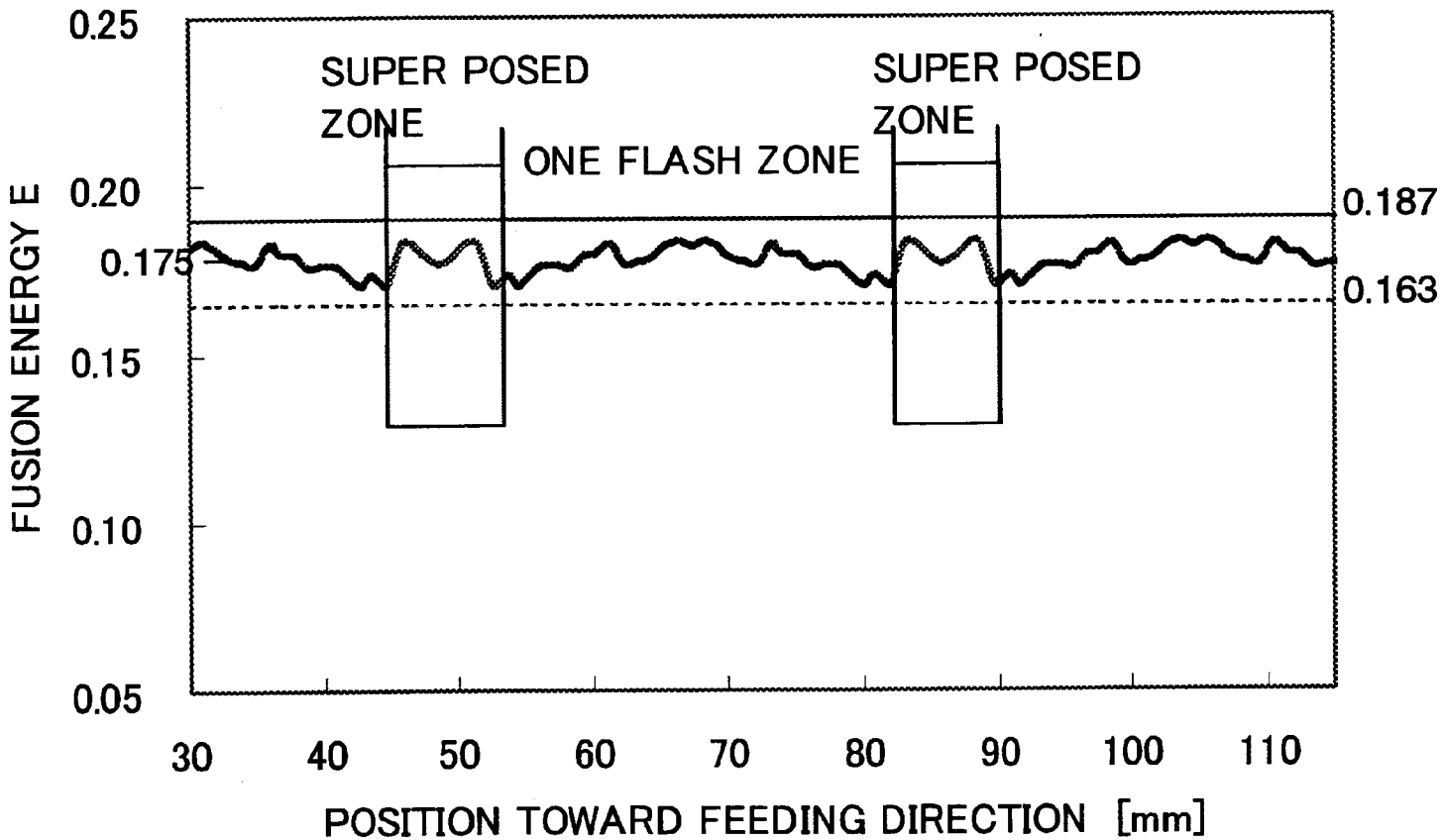
FIG. 18 shows an explanation diagram of fusion energy distribution by the flash fixing unit according to the first embodiment of the present invention.
Figure 21:
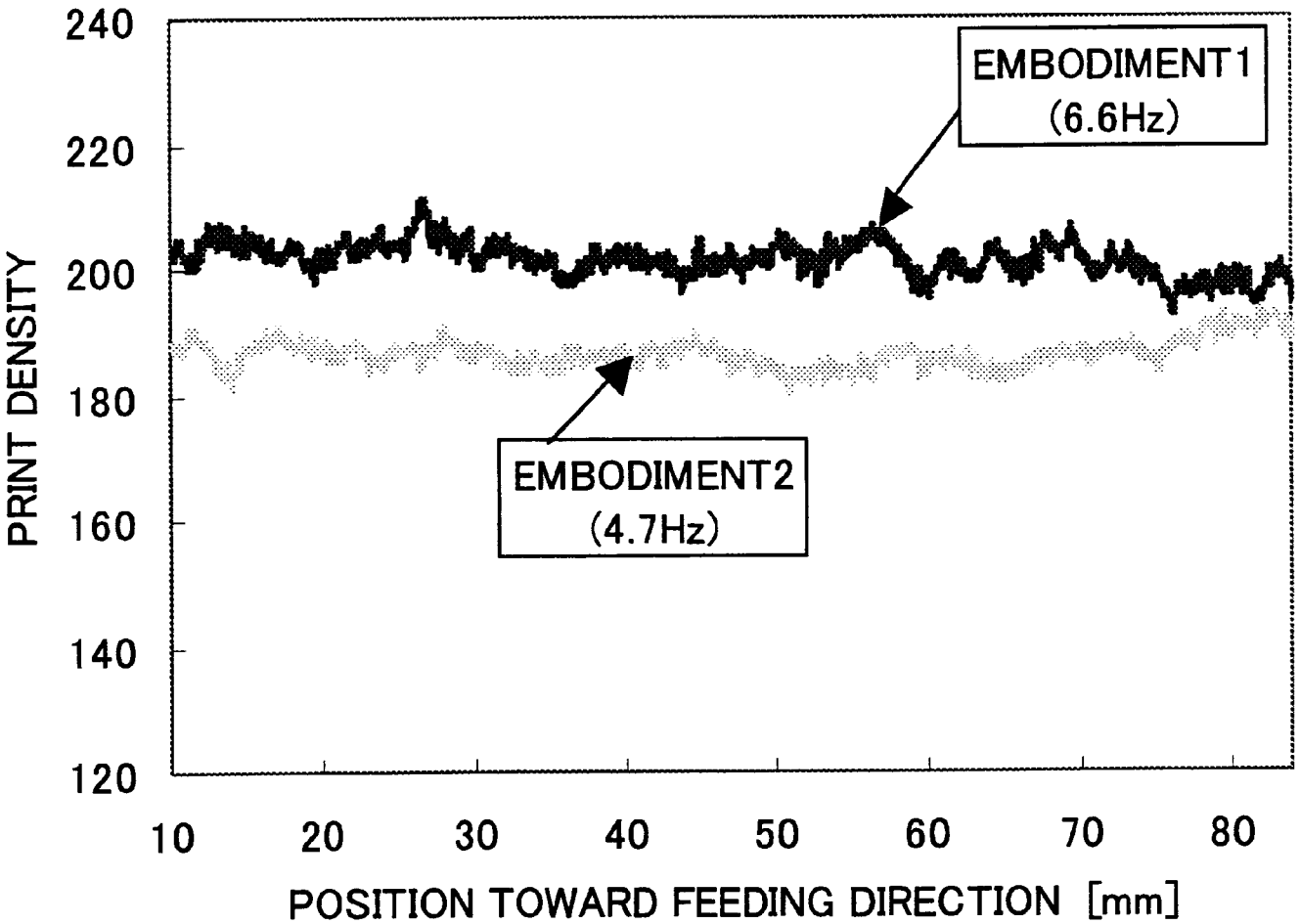
FIG. 21 shows an explanation diagram of the print result by means of the first and second embodiments of the flash fixing unit according to the present invention.
Figure 22:
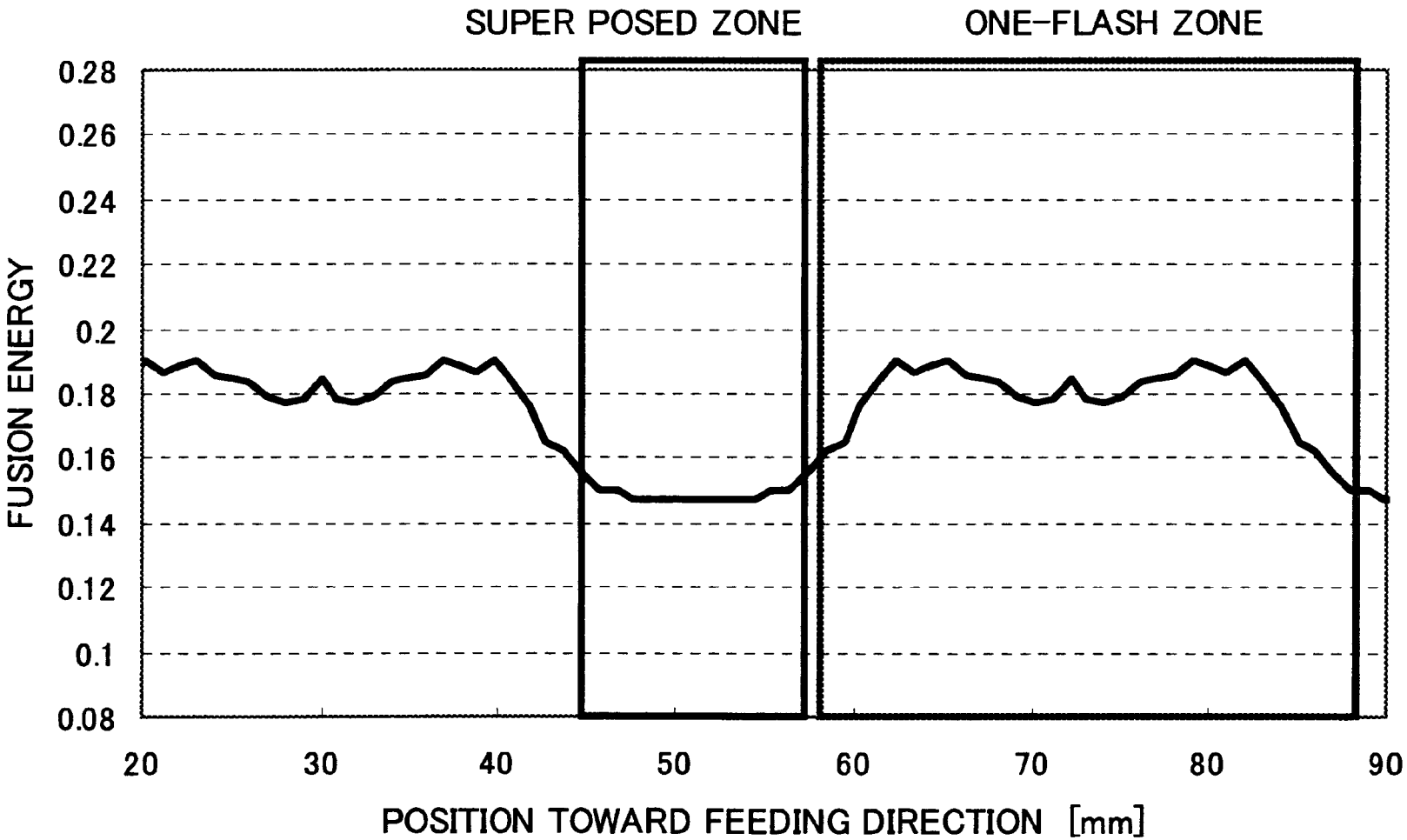
FIG. 22 shows a fusion energy distribution diagram in a prior art as a comparison example.
Figure 23:
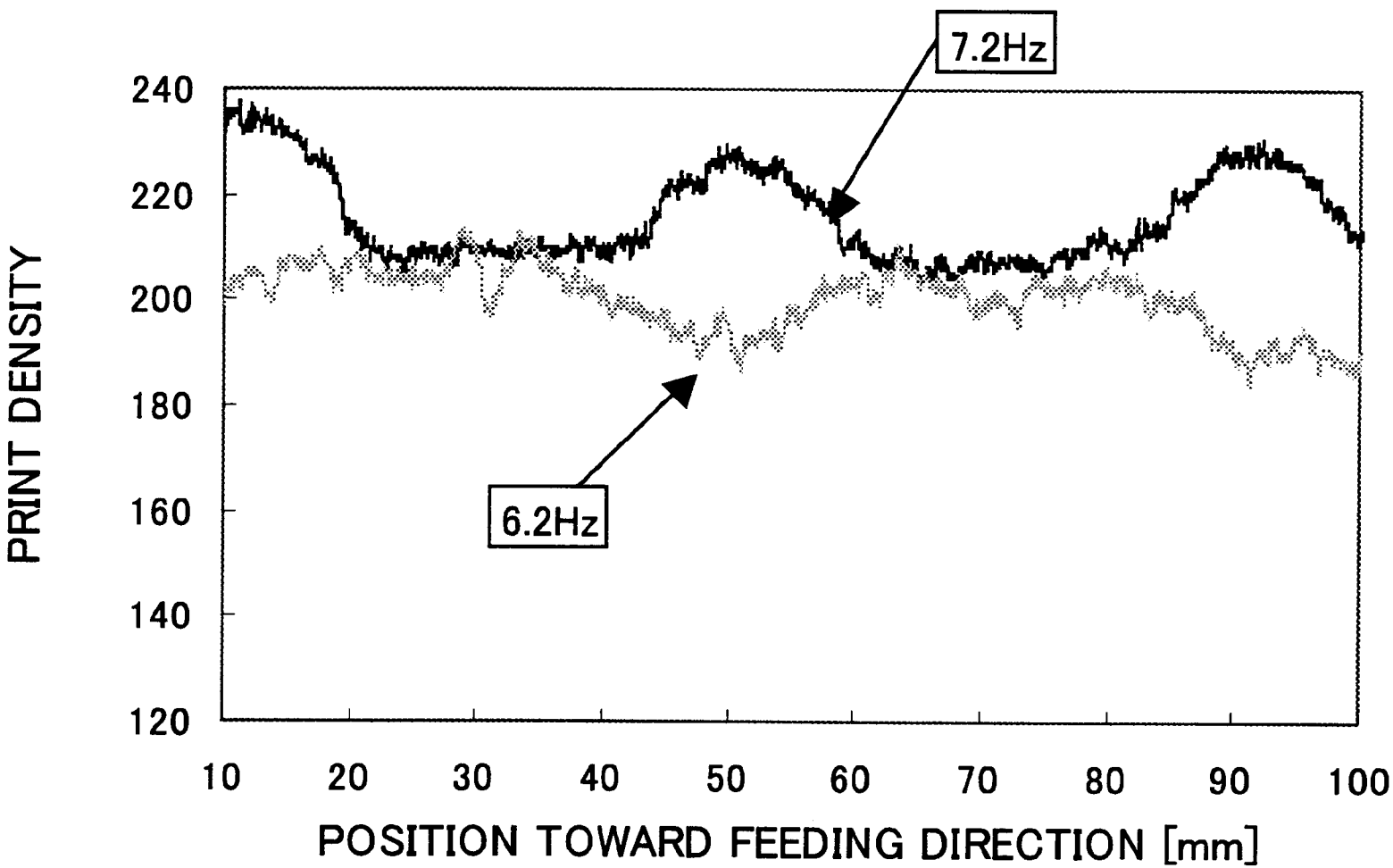
FIG. 23 shows an explanation diagram of the print result of the comparison example as compared to the first embodiment of the present invention.

Embodiment 1:

FIG. 18 shows a diagram of fusion energy distribution in case that the flashlight having the flash energy distribution shown in FIG. 15 is superposed according to the present invention. FIG. 19 shows an explanation diagram of setting values according to the respective embodiments of the present invention as well as an exemplary embodiment for comparison. FIG. 20 shows an explanation diagram for evaluating non-uniformity of print density according to the present invention. FIG. 21 shows a distribution diagram of scanner output value according to the first and second embodiments of the present invention. FIG. 22 shows a fusion energy distribution diagram in the conventional art. Also, FIG. 23 shows a distribution diagram of the scanner output according to the exemplary embodiment for comparison.

In the embodiment 1, a flash fixing unit shown in FIGS. 14, 15 is employed. As shown in FIG. 19, the fixing start energy β is set to 0.12, the feeding velocity v for the continuous medium 2 is set to 247.5 mm/sec, and the flash frequency f is set to 6.6 Hz. Thus each value (especially, flash frequency) is set so that formula (6) becomes true.

Namely, in the diagram of flash energy distribution shown in FIG. 15, 6.6 Hz is set as flash frequency f. Then, within the area having flash energy exceeding the fixing start energy β, the area excluding one-time flash zone (center zone) becomes the superposition zone. In FIG. 18, there is shown fusion energy distribution when flashlights are superposed. The fusion energy value falls within a range of ±7% of the aforementioned formula (6) (here, 0.163–0.187) centering the median H (here, 0.175).

Figure 30:
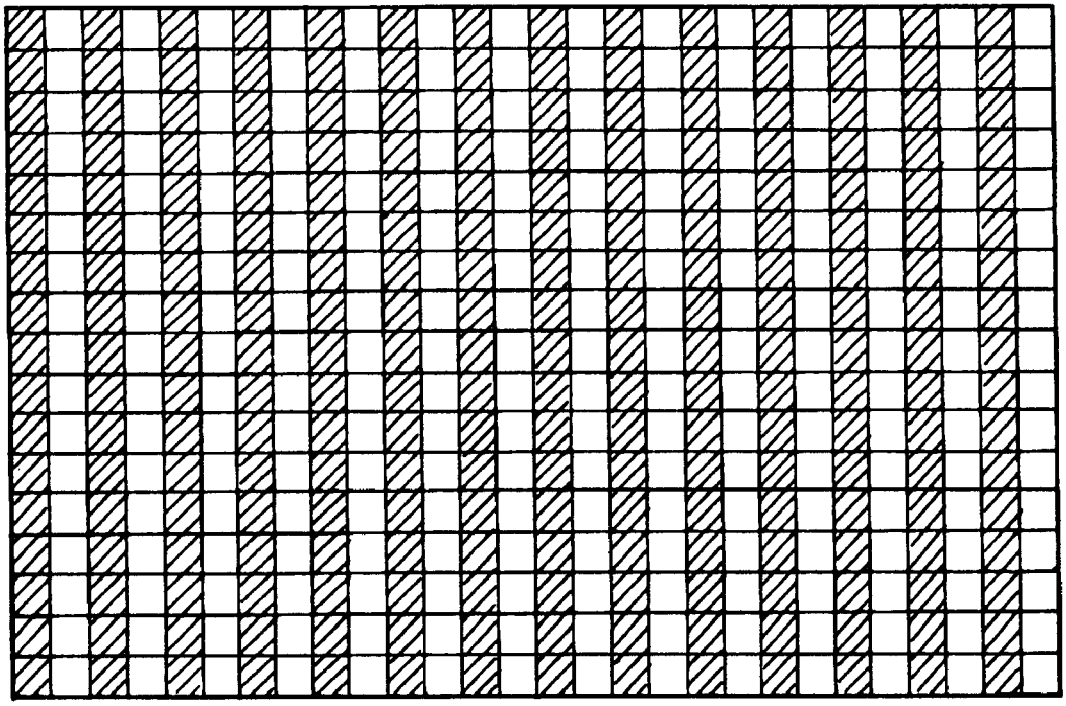
FIG. 30 shows an explanation diagram of a halftone image causing a problem in the prior arts.

Using this flash fixing unit, the density is measured against the toner pattern (having a resolution of 600 dpi) shown in FIG. 30 being fixed on the continuous paper by means of a densitometer. The measurement result is shown in FIG. 21. As shown in this figure, the density variation is quite small around the output value '200'.

Next, for the sake of comparison, according to a prior art of superposition so as to produce uniform flash energy distribution, the flash frequency f is 5.85 Hz as shown in FIG. 19 as a conventional method. The fusion energy distribution under this condition is illustrated in FIG. 22, in which the fusion energy in the superposition zone becomes lower than the fusion energy in the one-time flash zone, and thus non-uniform print density is produced.

Further, examples 1-1, 1–2 shown in FIG. 19 for the sake of comparison denote the cases of the flash frequency f being set as 6.2 Hz, 7.2 Hz, respectively, with other conditions remaining unchanged. Namely, these conditions do not satisfy formula (6). Using these flash fixing units shown in this comparative examples 1-1 and 1–2, the density is measured against the toner pattern (resolution of 600 dpi) shown in FIG. 30 being fixed on continuous paper. The density distribution result is shown in FIG. 23. As clearly understood from this figure, the density varies to a great extent in the carriage direction, which produces explicit non-uniformity of print density.

Next, FIG. 20 shows a result of survey on the extent of non-uniformity of print density that an observer actually distinguishes. In FIG. 20, there is shown the relation between subjective evaluation and the results of nine (9) samples obtained by changing flash frequencies. Each sample results produce different degrees of non-uniformity of print density. The non-uniformity of print density is calculated by the following formula, using the measured densities in the fixing result.

Non-uniformity of print density=[Density value on the one-time flash zone (i.e. flash center zone)−Density value on the superposition zone]/Density value on the one-time flash zone (i.e. flash center zone) Regarding the subjective evaluation, the samples are shown to randomly sampled twenty (20) evaluators who evaluate non-uniformity of print density of the samples based on a five-point evaluation (i.e. 'completely uniform'; 5 point, 'remarkably non-uniform'; 1 point). Thereafter, an average point is calculated to classify into the following: When the average point reaches 3.5 point or more, non-uniformity is small (denoted as ○ in FIG. 20). When the average point is below 3.5, non-uniformity is large (denoted as X). In addition, values of the non-uniform fusion energy are the same as the values of non-uniform print density.

When numerical figures representing non-uniformity of print density and non-uniformity of fusion energy exceed ±7%, the subjective evaluation concludes the print result is not allowable due to too much non-uniformity. In other words, the non-uniformity of fusion energy is tolerable up to ±7%. The lines shown in FIGS. 18, 15 show the lines of ±7%. Therefore, it is to be understood that there are obtained the fusion energy and the flash energy within the tolerable range of non-uniform density.

Further, as shown in FIG. 15, in the flash energy distribution according to the embodiment 1, the flash energy at the end zones of the fixing unit falls below the value β. In order to satisfy formula (6), it is necessary to set flash frequency f as 6.6 [Hz] as shown in FIG. 19. This requires input energy 13% higher than the input energy in the conventional example in which 5.85 [Hz] is applied.

Figure 24:
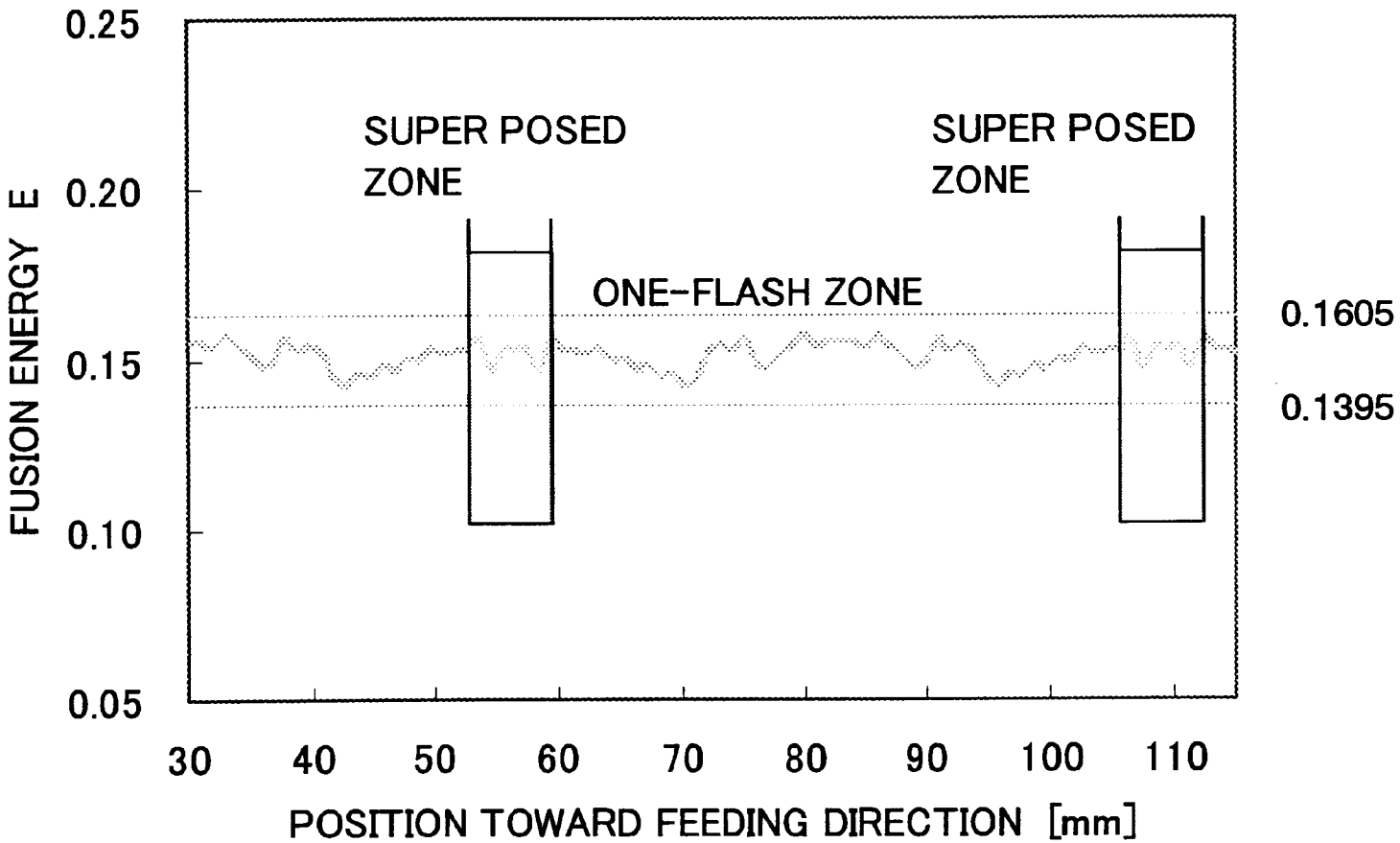
FIG. 24 shows a fusion energy distribution diagram of the second example of the flash fixing unit according to the present invention.
Figure 25:
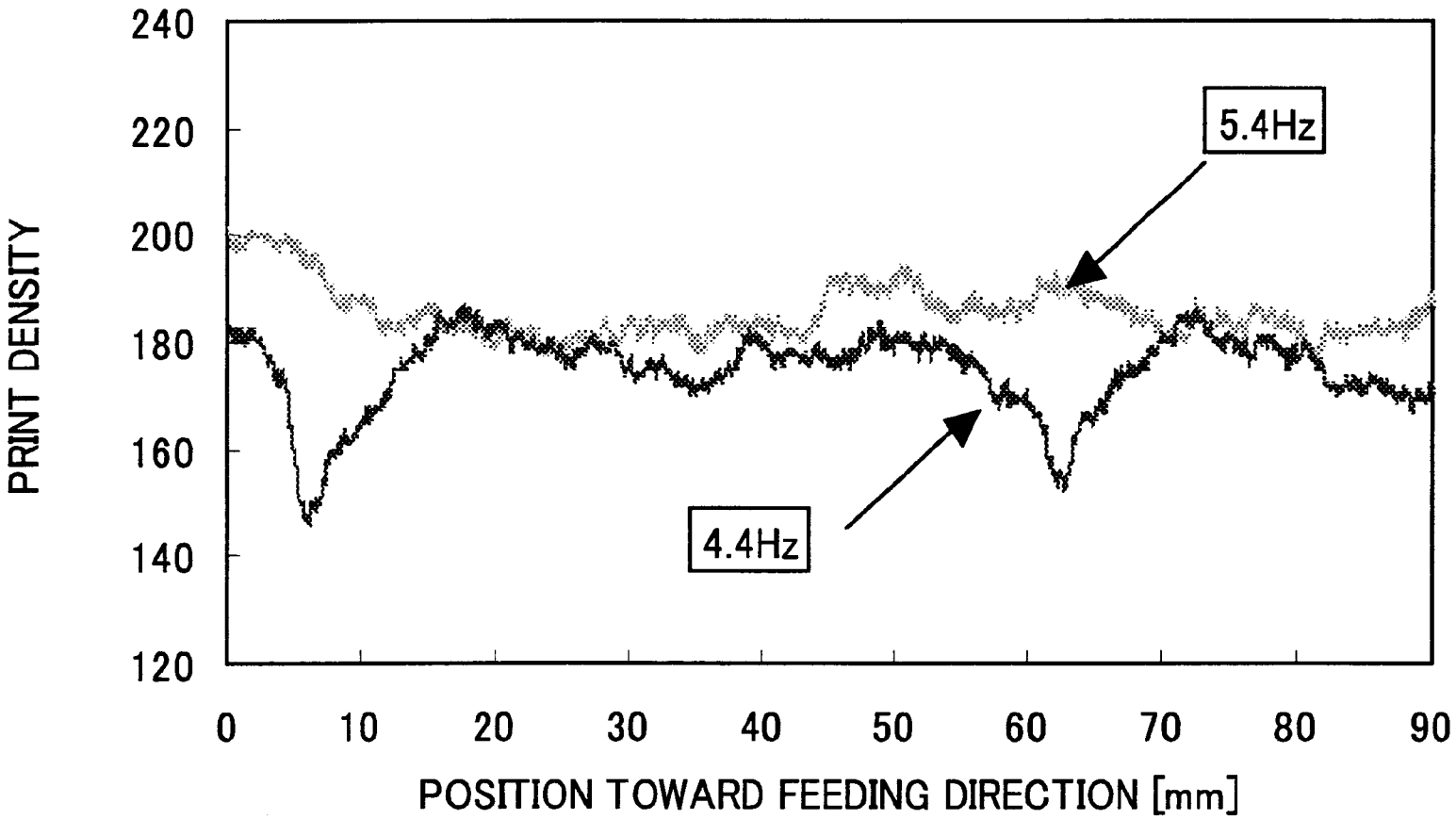
FIG. 25 shows an explanation diagram of the print result of the comparison example as compared to the second embodiment of the present invention.
Figure 26:
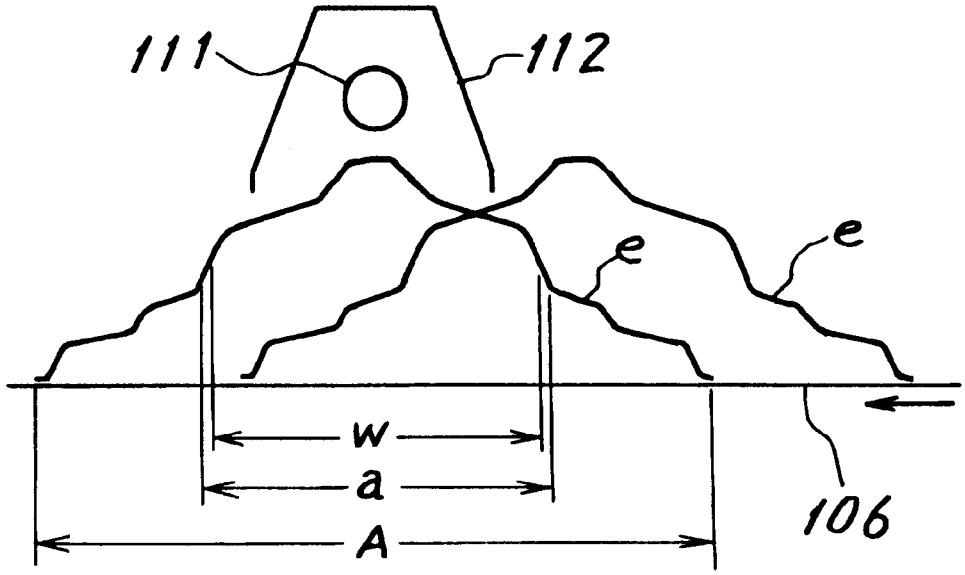
FIG. 26 PRIOR ART
FIG. 26 shows an explanation diagram of a first prior art.
Figure 27:
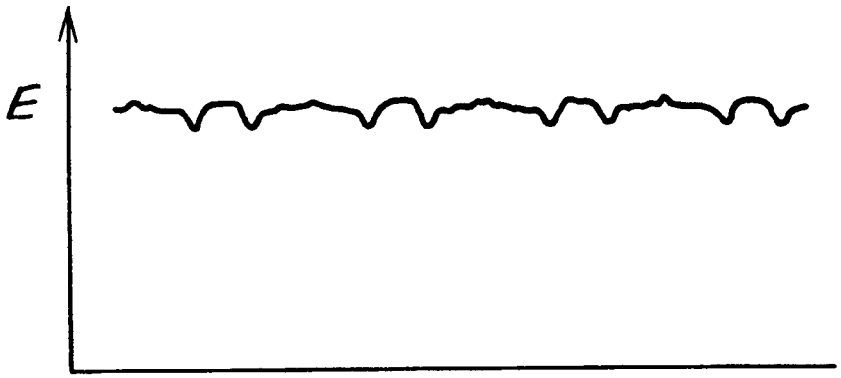
FIG. 27 PRIOR ART
FIG. 27 shows an explanation diagram of flash energy distribution according to the first prior art.
Figure 28A:
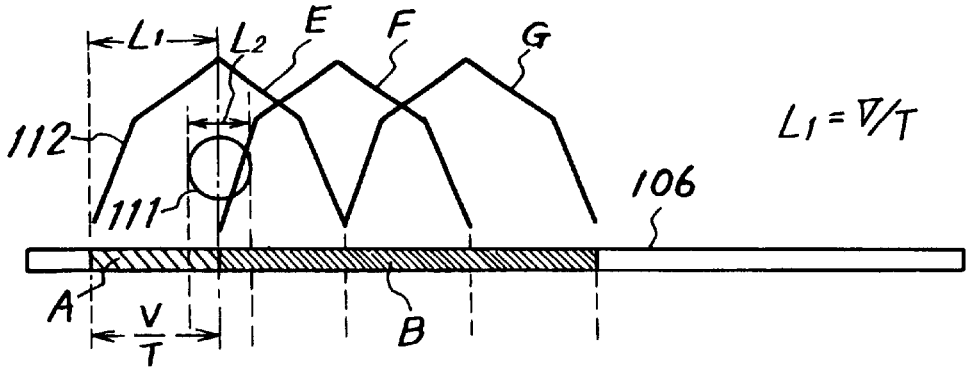
FIG. 28A PRIOR ART
FIGS. 28(A) and 28(B) show explanation diagrams of a second prior art.
Figure 28B:
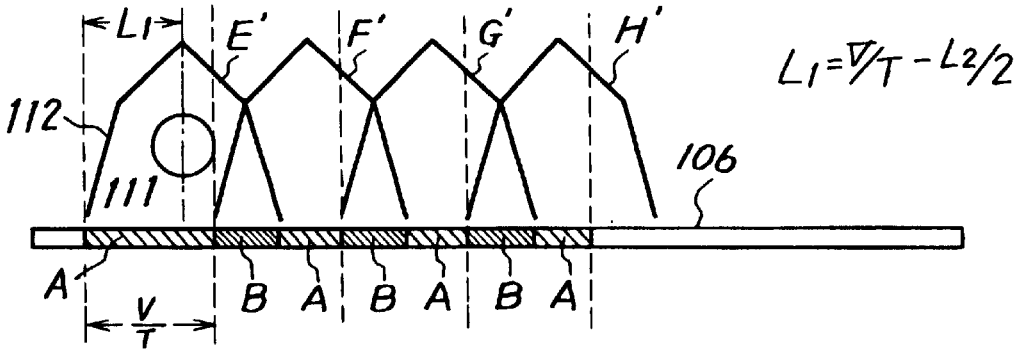
FIG. 28B PRIOR ART
Figure 29A:
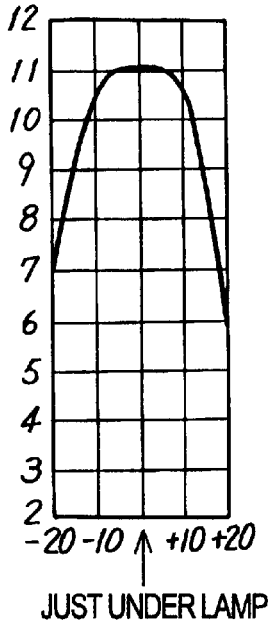
FIG. 29A PRIOR ART
FIGS. 29(A) and 29(B) show explanation diagrams of flash energy distribution according to the second prior art.
Figure 29B:
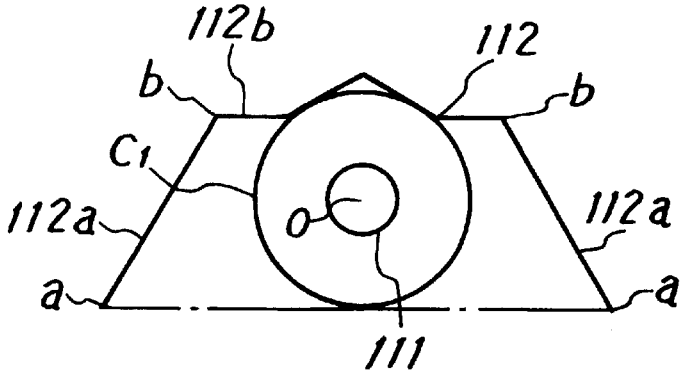
FIG. 29B PRIOR ART

Embodiment 2:

FIG. 24 shows a diagram of fusion energy distribution in case flashlights having flash energy distribution shown in FIG. 17 are superposed according to the present invention. FIG. 25 shows the distribution diagram of an example for comparison.

In the embodiment 2, a flash fixing unit shown in FIGS. 16, 17 is employed. As shown in FIG. 19, the fixing start energy β is set to 0.12, the feeding velocity v for the continuous medium 2 is set to 247.5 mm/sec, and the flash frequency f is set to 4.7 Hz. Thus each value (especially, flash frequency) is set so that formula (6) becomes true.

Namely, in the diagram of flash energy distribution shown in FIG. 17, 4.7 Hz is set as flash frequency f. Then, within the area having flash energy exceeding the fixing start energy β, the area excluding one-time flash zone (center zone) becomes the superposition zone. In FIG. 24, there is shown the fusion energy distribution when flashlights are superposed. The fusion energy values fall within a range of ±7% of the aforementioned formula (6) (here, 0.1395–0.1605) centering the median H (here, 0.15).

Using this flash fixing unit, the density is measured against the toner pattern (having a resolution of 600 dpi) shown in FIG. 30 being fixed on the continuous paper by means of a densitometer. The measurement result is shown in FIG. 21. As shown in this figure, the density variation is quite small around the output value '190'.

Next, for the sake of comparison, FIG. 19 shows examples 2-1, 2-2, in which flash frequency f is set as 4.4 Hz and 5.4 Hz, respectively, with other conditions remaining unchanged. Namely, these conditions do not satisfy formula (6). Using these flash fixing units shown in the comparative examples 2-1 and 2-2, the density of a toner image is measured by means of a densitometer after the toner pattern (resolution of 600 dpi) shown in FIG. 30 is fixed on the continuous paper. FIG. 25 shows the measurement result of the density distribution. As clearly understood from this FIG. 25, the density varies to a great extent in the feeding direction, which produces explicit non-uniformity of print density.

Further, as shown in FIG. 17, the minimum value of the flash energy corresponding to the aperture width W of the reflection plate is approximately equal to the value β. Therefore, as shown in FIG. 19, the setting value of flash frequency f becomes 4.9 [Hz]. This value is smaller than the value in the conventional example, and input energy decrease of 16% can be attained.

In such a way, it becomes possible to utilize energy efficiently by setting the minimum value of one-time flash energy within the area corresponding to the aperture width W of the reflection plate 15 to be equal to the value β. When the aforementioned minimum value is set below the value β, the frequency setting value increases as shown in the embodiment 1, thus increasing the input energy. To the contrary, when the aforementioned minimum value is set above the value β, excessive energy is used. This produces inefficiency and is not preferable. However, by decreasing flash voltage to make the minimum value substantially equal to the values β, it becomes possible to attain optimization.

[Other embodiments]

The aforementioned description of the present invention is based on the case in which a single flash lamp is employed in the flash fixing unit. However the method of the present invention can be applied to a flash fixing unit having a plurality of flash lamps. Also, although the aforementioned description relates to an electrophotographic printer, the method can be applied to a printer using any other printing method. Further, continuous paper in the description can be replaced by a cutting medium such as a cutting form, etc. In addition, the medium may not be limited to paper medium. Other medium such as film can also be applied.

To summarize, the present invention produces the following effects.

The fusion energy distribution on one-time flash irradiation zone is set to be substantially equal to the fusion energy distribution on the superposition zone. Thereby non-uniform print density having a flash frequency pitch can be eliminated when printing a high-resolution halftone image. Thus high quality image can be obtained.

Further, using a reflection plate so as to make the minimum value of one-time flash energy in the aperture width of the reflection plate substantially equal to the value β, a print image having uniform print density can be obtained with minimum input energy.

The foregoing description of the embodiments is not intended to limit the invention to the particular details of the examples illustrated. Any suitable modification and equivalents may be resorted to the scope of the invention. All features and advantages of the invention which fall within the scope of the invention are covered by the appended claims.

What is claimed is:

1. A flash fixing apparatus for flash-fixing a toner image onto a medium being carried at a predetermined carriage velocity, comprising:

a flash fixing unit having a flash lamp and a reflection plate disposed to surround said flash lamp excluding at an aperture portion, so as to reflect light from said flash lamp to direct toward said aperture portion; and a controller for controlling to flash said flash lamp, wherein said flash fixing unit has a flash energy distribution on the medium, that is produced by a single flash of said flash lamp, the flash energy distribution having substantially a constant value at a center zone of said flash energy distribution and decreasing values at both a front zone and rear zone thereof as each position therein becomes farther from said center zone, wherein the flash fixing unit flashes at a flash frequency f such that the rear zone of one flash overlaps the front zone of a succeeding flash within a superposition zone on the medium;

wherein a fusion energy distribution is obtained by subtracting a fixing start energy β from said flash energy distribution; and and wherein said controller controls a said flash frequency f such that said fusion energy distribution within the superposition zone is substantially equal to a fusion energy distribution within the center zone that is outside the superposition zone, whereby fusion energy is substantially uniform across the medium.

2. The flash fixing apparatus according to claim 1 wherein said controller controls to flash said flash lamp with a flash frequency f which satisfies the following formula;

$$g(x)+g'(v/f+x)-\beta=H\pm\alpha\%$$

where, v is said carriage velocity, f is said flash frequency, H is said value at the center zone, g(x) is a characteristic at said front zone, g'(v/f +x) is a characteristic at said rear zone, α is an arbitrary constant, and β is said fixing start energy.

3. The flash fixing apparatus according to claim 2 wherein 7 is set as said constant α.

4. The flash fixing apparatus according to claim 1 wherein the minimum value of flash energy within a range of said flash energy distribution corresponding to an aperture width of said reflection plate corresponds to said fixing start energy.

5. The flash fixing apparatus according to claim 4 wherein said reflection plate shape is structured such that the minimum value of flash energy within said flash energy distribution range corresponding to said reflection plate aperture width corresponds to said fixing start energy.

6. The flash fixing apparatus according to claim 5 wherein said reflection plate comprises a side reflection portion;

a ceiling reflection portion; and a convex portion disposed in said ceiling reflection portion.

7. The flash fixing apparatus according to claim 1, wherein said fixing start energy is determined by a width of said toner fixed by a single flash of said flash lamp.

8. A printer for forming a toner image on a medium carried at a predetermined carriage velocity, comprising:

an image forming means for forming a toner image onto said medium; and a flash fixing apparatus for fixing said toner image onto said medium using flashlight, wherein said flash fixing apparatus comprising:

a flash fixing unit having a flash lamp and a reflection plate disposed to surround said flash lamp excluding at an aperture portion, so as to reflect light from said flash lamp to direct toward said aperture portion; and a controller for controlling to flash said flash lamp, wherein said flash fixing unit has a flash energy distribution on the medium, that is produced by a single flash of said flash lamp, the flash energy distribution having substantially a constant value at a center zone of said flash energy distribution and decreasing values at both a front zone and rear zone thereof as each position therein becomes farther from said center zone, wherein the flash fixing unit flashes at a flash frequency f such that the rear zone of one flash overlaps the front zone of a succeeding flash within a superposition zone on the medium;

wherein a fusion energy distribution is obtained by subtracting a fixing start energy β from said flash energy distribution; and and wherein said controller controls said flash frequency f such that said fusion energy distribution within the superposition zone is substantially equal to a fusion energy distribution within the center zone that is outside the superposition zone, whereby fusion energy is substantially uniform across the medium.

9. The printer according to claim 8 wherein said controller controls to flash said flash lamp with a flash frequency f which satisfies the following formula;

$$g(x)+g'(v/f+x)-\beta=H\pm\alpha\%$$

where v is said carriage velocity, f is said flash frequency, H is said value at the center zone, g(x) is a characteristic at said front zone, g'(v/f +x) is a characteristic at said rear zone, + is an arbitrary constant, and ⊖ is said fixing start energy.

10. The printer according to claim 9 wherein 7 is set as said constant α.

11. The printer according to claim 8 wherein the minimum value of flash energy within said flash energy distribution range corresponding to said reflection plate aperture width corresponds to said fixing start energy.

12. The printer according to claim 11 wherein said reflection plate shape is structured such that the minimum value of flash energy within a range of said flash energy distribution corresponding to said aperture width of said reflection plate corresponds to said fixing start energy.

13. The printer according to claim 12 wherein said reflection plate comprises:

a side reflection portion;

a ceiling reflection portion; and a convex portion disposed in said ceiling reflection portion.

14. The printer according to claim 8, wherein said fixing start energy is determined by a width of said toner fixed by a single flash of said flash lamp.

* * * * *